US005335425A

United States Patent [19]

Tomizawa et al.

[11] Patent Number: 5,335,425

[45] Date of Patent: Aug. 9, 1994

[54] DRY-PROCESSING APPARATUS FOR HEATING AND DRYING OBJECTS TO BE PROCESSED

[75] Inventors: Takeshi Tomizawa, Ikoma; Tatsuo Fujita, Osaka; Kunihiro Ukai, Ikoma; Jiro Suzuki, Nara, all of Japan

[73] Assignee: Matsushita Electric Industrial Co., Ltd., Osaka, Japan

[21] Appl. No.: 928,436

[22] Filed: Aug. 12, 1992

[30] Foreign Application Priority Data

| | | | |
|---|---|---|---|
| Aug. 14, 1991 | [JP] | Japan | 3-204184 |
| Nov. 27, 1991 | [JP] | Japan | 3-312063 |
| Dec. 27, 1991 | [JP] | Japan | 3-346019 |
| Apr. 27, 1992 | [JP] | Japan | 4-107385 |
| May 18, 1992 | [JP] | Japan | 4-124364 |
| May 25, 1992 | [JP] | Japan | 4-132768 |

[51] Int. Cl.[5] ..... F26B 3/34

[52] U.S. Cl. ..... 34/265; 34/74

[58] Field of Search ..... 34/1 Q, 1 P, 1 DD, 27, 34/32, 73, 74, 77, 28, 79; 219/10.55 R, 10.55 A

[56] References Cited

U.S. PATENT DOCUMENTS 4,704,972 11/1987 Marchand .
5,154,008 10/1992 Chicot ..... 34/73

FOREIGN PATENT DOCUMENTS 1-139182 5/1989 Japan .
4-3803 1/1992 Japan .

*Primary Examiner*—Henry A. Bennett
*Attorney, Agent, or Firm*—Wenderoth, Lind & Ponack

[57] ABSTRACT

In a dry-processing apparatus, a heat insulating container is interposed between an inner container for accommodating objects to be dried and a condensing outer container which is cooled by a fan. The inner container is made of a microwave transmittable material having excellent heat resistance. The adopted heat insulating container is made of a microwave reflecting material. Microwaves are generated by a microwave oscillator to heat the objects to generate vapor from the objects. The generated vapor contacts the cooled condensing outer container so as to be condensed into water. A temperature sensor is provided at the upper portion of the condensing outer container so as to detect the temperature of the generated vapor to thereby control the heating and drying operation.

26 Claims, 11 Drawing Sheets

DRY-PROCESSING APPARATUS FOR HEATING AND DRYING OBJECTS TO BE PROCESSED

BACKGROUND OF THE INVENTION

1. Field of the Invention

The present invention relates to a dry-processing apparatus for dry-processing objects to be dried such as foods, industrial materials, garbage, and industrial waste, and in particular to a dry-processing apparatus relatively small in size, convenient and sanitary in use for heat-drying raw garbage, foodstuff, feedstuff and powdered materials generated in kitchens or hospitals and other waste having a relatively high moisture content.

2. Description of the Prior Art

As a means to solve environmental problems on our Earth, waste disposal techniques for processing household garbage or industrial waste materials are beginning to draw people's attention. Conventional waste disposal devices range from a mechanical processing machine called a disposer to an incinerator which uses gas fuels or liquid fuels. The mechanical processing machines process garbage by shredding it with rotating blades and then by disposing of the shredded garbage in a local drainage system. The incinerators process garbage by using burners to heat and burn the garbage to ashes. Another waste disposal device available is one which employs microwave radiation.

Such conventional devices, however, suffer from the following disadvantages. The mechanical processing machines are capable of reducing garbage in its size. Disposing of shredded garbage into the drainage system, however, greatly increases the percentage of a solid waste within the drainage system, possibly causing the local drainage system to clog. This is often an issue facing local governments. On the other hand, the disadvantages of the incinerators is that they are bulky and complex in structure, because they need gas fuels or liquid fuels. Although the waste disposal device which uses microwaves to burn garbage is free from the above-mentioned disadvantages such as drainage system clogging and bulky and complex structure, the microwave disposal device exhibits poor emission characteristics (inadequate for household application) and causes condensation as a result of moisture contained emissions. Such emissions may contaminate or damage the ambient environment of any facility where the microwave disposal device is installed. The present invention overcomes the above described disadvantages presented by the microwave disposal device.

In the meantime, a method of drying food has been widely accepted for preserving food for a long period of time. Among other methods, hot-air drying, drying by microwave heating, freeze drying, and spray drying are widely used, and are now playing an important role in long-term preservation of food. Like dried food, household garbage may be easy to handle once it is dried and dehydrated.

In a heat-drying operation, liquids separated are normally emitted as a gas such as a vapor into the ambient air. In some cases, vapor is condensed along with odors in a manner that keeps the odors entrapped. Such a process is typically applied to a large-scale cooling device, such as a cooling plant, which is equipped with a drying block and a condensation block on a separate basis. Such separate construction is not suited to a small-scale design.

Electric-powered drying methods applied to small-scale designs typically involve contact heating by heaters or non-contact heating by microwave radiation. In contact heating by heaters, non-uniform heating and then non-uniform drying take place, thereby decomposing an object to be dried, and developing odors. The microwave heating suffers the same disadvantages as those of the contact heating, because it is difficult to uniformly distribute the microwave electric field intensity.

In a conventional rotating type heat-drying apparatus, although the drying progresses successfully while the drying objects are still wet by virtue of a good heat transfer, as the moisture thereof decreases, the heat transfer will become worse such that the drying will require a longer time period and moreover the drying objects disadvantageously adhere to the rotating basket.

Moreover, the heat sources employed in dry-processing apparatuses are, for example, of an electric heater type, a combustion heat type, a microwave type, and the like. The electric heater type apparatus has advantages in safety and controllability, but generates a significant heat loss which makes it difficult to increase the drying efficiency. The combustion heat type dry-processing apparatus uses a gas fuel, liquid fuel, or the like, which results in a complicated large-size apparatus accompanied by deficiency in safety. In contrast to the above-mentioned types, since the microwave type drying apparatus has a high drying efficiency because the microwaves are selectively absorbed in moisture contained in the drying objects, no complication nor increase in size of the apparatus itself results, for which reason the microwave type is appropriate for dry-processing drying objects having a high moisture content.

However, such a conventional microwave type drying apparatus has the following problems. Since microwaves tend to have an uneven intensity distribution, it is difficult to effect a uniform dry-processing of objects and, practically, the drying objects located at lower positions remain wet even when the drying apparatus is finished processing them. Particularly when the drying object is garbage, boiled liquid of the garbage remains in the lower portion and is unsanitary.

Furthermore, vapor generated from the drying objects is condensed into dew after the drying objects are removed, which results in contamination of the inside and outside of the drying chamber. If microwaves are continuously applied to the drying objects after the drying objects are dried, the drying objects may catch fire and cause danger. Accordingly, the object of the present invention is to provide a microwave type drying apparatus capable of achieving a high condensation of vapor generated from the drying objects while reducing the volume of the drying objects with sufficient sanitation.

Whereas the garbage, as described above, should be stored until the specified time to collect it and near the place where it is created, it will form an environment in which the garbage is itself likely to decompose due to its large moisture content. As a result, a first great problem has been that the decomposition progresses during the storage of garbage and generates a fowl odor. A second great problem has been that garbage increases in weight due to its large moisture content so as to make a heavy burden of conveying the packs, in which the garbage is accommodated, to the specified place where they are collected. Also, it is very often the case that the moisture will leak out of the packs, in which garbage is collected, during the conveyance of the packs up to the collecting place, in which case the remainder will cause a secondary odor to occur. The solution to this problem has been urgently expected, especially by those living in collective housing.

As viewed with respect to the foregoing problems, conventional garbage disposing apparatus, although capable of crushing garbage into minute pieces, cause great amounts of solid and organic components to be included in the drainage which appears after the disposal of garbage, and which accounts for organic pollution of rivers and the like. The incinerating system has not yet solved problems including the generation of odor during the incineration, and processing of ashes that are difficult to dispose. Also, the drying system, capable of reducing the weight of garbage and making it free of decomposition, has nonetheless had difficulties in uniformity of drying, power consumption, processing of vapor and odor to be generated.

Accordingly, with the conventional methods having their peculiar problems as described above, it can be said that we have up to now had no sufficiently small sized garbage disposing apparatus that can serve for practical uses. It has been demanded to realize this aim.

SUMMARY OF THE INVENTION

It is, therefore, an essential object of the present invention to provide a dry-processing apparatus for heating and drying objects such as food, garbage and the like, which allows for clean and hygienic dry-processing and waste disposal, by enhancing the condensation of vapor contained in the objects and by controlling odorous constituents given off in the course of the drying operation.

In order to achieve the aforementioned objective, a dry-processing apparatus of the present invention comprises: a shielding container (also referred to as a condensing container) made of a microwave shielding material; receptacle means having a heat-insulating property for accommodating objects to be dried, the receptacle means being installed inside the shielding container with a space around the receptacle means; microwave oscillator means for generating microwave radiation and directing the microwave radiation to the objects accommodated in the receptacle means to thereby heat the objects; cooling means for cooling the wall of the shielding container so as to condense vapor emitted from the heated objects; and temperature sensor means for detecting the temperature in the atmosphere inside the receptacle means and detecting the temperature of the vapor emitted from the heated objects. The heating and drying operation is terminated at the moment the temperature detected by the temperature sensor means exceeds a predetermined temperature threshold in the final phase of the heating and drying operation.

The receptacle means may serve as a part of the microwave-shielding container and the heat-insulating material of the receptacle is mainly composed of a metal material.

According to another feature of the present invention, the receptacle means is preferably rotated by rotation drive means and is mounted in a slanted orientation. Moreover, the insulating capability of the rotating receptacle is greater than that of the condensing container such that the temperature of the condensing container remains low and allows the condensing container to exhibit an excellent condensation performance.

According to another feature of the present invention, the rotatable receptacle further comprises a protruding member on the interior side wall thereof for contacting a plastic bag which accommodates samples to be dried. Moreover, an electric heater may be used as the heating means instead of a microwave oscillator. The dry-processing apparatus further comprises deodorizing means located in the vicinity of a lower end of the condensing container.

According to a further feature of the present invention, the receptacle means has at least a part of its bottom made of a microwave transmittable material and the condensing means has a lid member to close its opening and has its bottom provided with a microwave inlet portion. The receptacle means consists of an inner container made of a microwave transmittable material and a separate outer cylindrical container made of a heat-insulating material placed outside the inner container, and the outer cylindrical heat-insulating container is fixed to the condensing means, whereby only the inner container is rotated by the rotation drive means. Moreover, the inner container may have its cylindrical side wall made of a heat-insulating material and its bottom made of a microwave transmittable material, both the cylindrical side wall and the bottom being integrally connected.

According to another feature of the present invention, the heat-insulating means having a double wall structure made of a metal material with its inside evacuated to an approximate vacuum condition is provided between the receptacle means and the condensing means for isolating the receptacle means from the condensing means.

According to yet another feature of the present invention, the heating means as well as the air feeding means for feeding hot air are both located above the receptacle means.

As described above, the main component of household garbage is moisture. It is known that the moisture content in normal garbage is 70 to 80% by weight. Since microwave radiation is selectively absorbed by moisture, the microwave radiation can be effectively utilized as a heat source in processing household garbage.

Another advantage of the microwave radiation is that its heat transfer mechanism does not depend on the configuration of garbage to be heated which is usually in the form of bulk rather than being in a fixed solid form. When subjected to the microwave heating, however, the garbage begins being decomposed by the heat, and occasionally this occurs at almost the same time that the drying operation is ending, which probably leads to firing (burning). Transient phenomena leading to firing were studied in detail by the inventors in an effort to avoid such a risky situation. The study revealed that a temperature increase was observed both in temperature of the atmosphere within a garbage receptacle and in temperature of vapor developed from the garbage during a transitional period before thermal decomposition of the garbage and subsequent firing.

Such a temperature rise may be attributed to the following reasons: the boiling point of the garbage moisture content as a whole rises because the garbage contains less and less residual moisture in the drying process; and the microwave radiation is absorbed by components other than moisture, and, then, excessively heated steam develops because of localized heating due to uneven distribution of the microwave intensity. If the temperature rise likely to be followed by subsequent transient phenomena is detected, and drying may be stopped when the detected temperature exceeds a predetermined temperature threshold value. Thus, it is possible to avoid thermal decomposition and firing of the garbage, which were difficult to control in the prior art microwave heating and drying method.

Moreover, a continuous heating and drying operation inevitably develops a slight amount of decomposed constituents resulting from localized temperature increases in the object to be dried, because moisture is not uniformly distributed in the object and because the heating means transfers heat to the object in a non-uniform pattern. The object is normally dried from above, and, thus, the bottom portion of the object tends to be left undried.

When a rotating receptacle is rotated around a tilted axis, in the manner of a concrete mixer, to agitate the object, the object may be uniformly dried. Since the heated object remains agitated, while touching the internal surface of the rotating receptacle, heat is transferred to the rotating receptacle. If the rotating receptacle has a poor insulating capability, heat of the object is transferred via the rotating receptacle, and reaches the condensing container. The condensing container is heated, thereby lowering condensation performance of the condensing container.

According to the present invention, the insulating capability of the rotating receptacle is greater than that of the condensing container, the temperature of the condensing container remains low, providing the condensing container with an excellent condensation performance. Thus, the object is uniformly heated and dried, minimizing the development of decomposed constituents and giving off no odorous emissions because the decomposed constituents are condensed.

With a construction in which a microwave generator is located below the condensing container, when the microwave generator is made to operate after putting the drying objects into the receptacle, the microwaves start to heat the drying objects accommodated in the receptacle from the bottom of the condensing container. In particular, with regard to moisture in the drying objects, the microwaves are selectively absorbed in the moisture such that the drying objects are gradually dried and vapor is generated. In the above-mentioned manner, since the microwaves are radiated from the bottom part of the drying objects, even when the drying objects are garbage, there is no possibility of leaving boiled liquid in the bottom of the receptacle and sanitation is thereby assured. By placing a microwave inlet at the bottom of the condensing container, a compact apparatus can be achieved while easily assuring prevention of microwave leakage from the lid of the receptacle.

On the other hand, by operating a wind fan together with the microwave generator to cool the external surface of the condensing section, almost all of the vapor generated from the drying objects is condensed into dew in the condensing container and discharged as condensate through the condensate outlet out of the condensing container.

Furthermore, by rotating the receptacle at a slant and also operating the microwave generator and the wind fan, the drying objects are stirred so as to be uniformly dried, and heat transfer is promoted to achieve a high condensation performance of the vapor generated from the drying objects. By stirring the drying objects, the drying objects can also be reduced in volume.

Furthermore by placing a cylindrical heat insulating container outside the drying object accommodating inner container, heat radiation from the drying objects is controlled to achieve high operational efficiency. Because only the inner container made of a microwave transmittable material is made to rotate, the required rotational torque is reduced.

Furthermore, by integrating the receptacle in a body, a simple construction of the apparatus can be achieved.

In another construction of the present invention, the garbage accommodating section is partitioned from the condensing section on its periphery by the heat-insulating section, thereby preventing non-uniformity in temperature of the garbage being processed so that uniform drying can be achieved. At the same time, heat loss of the garbage during the heating is reduced to a minimum, thereby improving the heating efficiency.

The heat-insulating structure, on the other hand, functions to prevent the condensing section formed outside the structure from increasing in temperature while the vapor generated from the garbage can be almost fully condensed by effectively utilizing the cooling means. The odor generated from the garbage is also condensed together with the vapor, lessening the amount of the vapor and odor discharged to the outside. Efficient moisture separation and condensation has been achieved even with the compact, simple construction of the apparatus of the present invention. In consequence, it has been made possible to easily dry-process the garbage without causing decomposition thereof and with almost no odor production.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Embodiment 1

Figure 1:
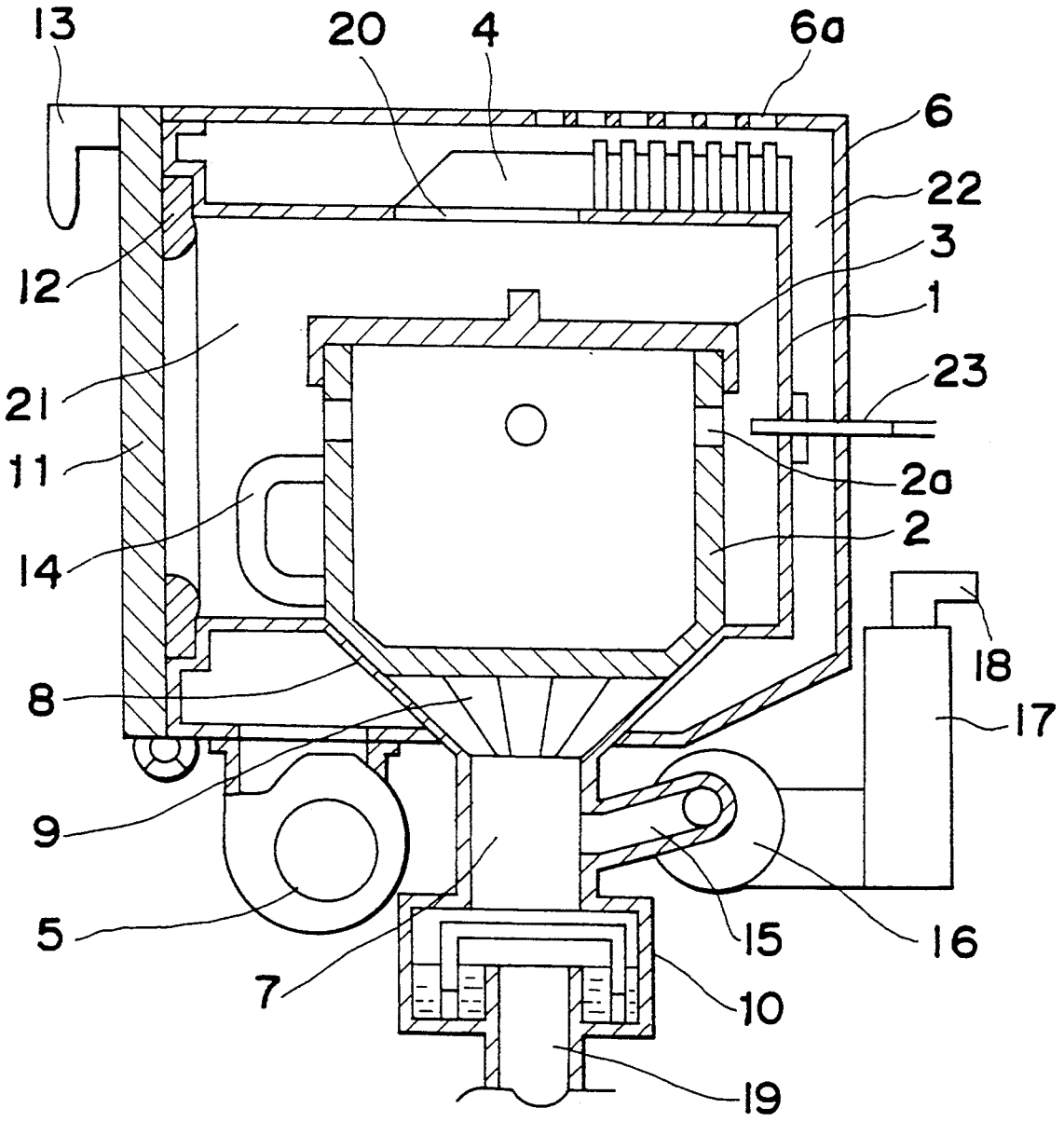
FIG. 1 is a sectional view showing a first embodiment of a dry-processing apparatus according to the present invention.

FIG. 1 shows a first embodiment of a garbage disposing apparatus according to the present invention.

Referring to FIG. 1, designated by a reference numeral 1 is a shielding container which is made of a microwave shielding material which can shield against microwave radiations and which exhibits good thermal conductivity. The container 1 should prevent microwave radiation from escaping while being used as a condensation container. The container 1 is thus preferably made of aluminum alloy with its inner surface coated with fluorine based resin. The lower part of the container 1 has a drainage funnel 8 with channels 9, which is connected to a drainage pipe 7, a condensed trap 10 and a local drainage system 19. In this embodiment, condensed water condensed by the inner surface of the container 1 is drained to the drainage system 19. Alternatively, a basin may be detachably disposed below the container 1 to collect the condensed water, such that each time the basin becomes full, it may be emptied. Numeral 2 is a heat-insulating garbage receptacle made of heat-insulating material, containing, as its base component, heat resisting foam plastic which is at the same time microwave transmittable material. The garbage receptacle 2 has an inner lid 3 and a handle 14, both of which are made of the same material as the receptacle 2. Also, the garbage receptacle 2 has a plurality of vapor exhaust holes 2*a*. The garbage receptacle 2 is installed in the shielding container 1 such that a space 21 is left around the garbage container 2 for condensation activity. Numeral 4 is a microwave oscillator which generates microwave radiation to be directed through a microwave entry window 20 to garbage to be heated. The microwave oscillator 4 is mounted in a ventilation chamber 22 enclosed by the shielding container 1 and an outer casing 6. A ventilation fan 5 dries air into the ventilation chamber 22. The outer casing 6 has a number of exhaust air holes 6*a*. A front door 11 can be swung open forward, has a gasket 12 to assure sealing when the front door 11 is closed, and has a handle 13 to open or close the front door 11. Numeral 23 is a temperature sensor which is inserted through the shielding container 1 in a manner such that the probe tip of the temperature sensor 23 faces one of the vapor exhaust holes 2*a*. To ensure that the temperature sensor tip accurately faces the vapor exhaust holes 2*a* and is in line with one of the vapor exhaust holes 2*a*, a location means (not shown) is provided on the bottom of the garbage receptacle 2 on the floor portion of the shielding container 1.

In this embodiment, a sheathed thermocouple is employed as the temperature sensor 23. Alternatively, other types of temperature sensors, such as a thermistor type sensor, may be employed. Consideration should be given to the attachment of the temperature sensor 23, however. For example, since the temperature sensor 23 is projected into the space where the microwave radiation is ubiquitous, the sheath of the temperature sensor 23 should be firmly grounded to the shielding container 1 to avoid static build-up and subsequent discharge. To achieve an improved response characteristic and reliability in temperature detection, it is desired that the heat capacity of the probe body of the temperature sensor 23 be made as small as possible and that the probe body be thermally insulated from the wall of the shielding container 1. It may be perfectly acceptable for the probe body of the temperature sensor 23 to be further projected, through the vapor exhaust holes 2*a*, and into the interior space of the garbage receptacle 2.

A suction fan 16 draws exhaust gases through a suction tube 15 which is branched from the drainage pipe 7. The suction fan 16 sends gases to a deodorizing device 17 where the gases are deodorized, and the deodorized gases are then exhausted through an exhaust pipe 18 out of the disposal apparatus. Suction requirements of the suction fan 16 are not very critical; any fan may be acceptable if it can exhaust gases.

In this embodiment, the deodorizing device 17 employs oxidation catalysis. Alternatively, other deodorizing methods may be employed. Depending on operational requirements, for example, the following deodorizing methods may be selected singly or in combination: an absorption method using an absorbent such as activated carbon-, silica-, alumina-, zeolite-and ion exchange resin-based absorbent, an oxidation dissolving method using ozone, a deodorizing method using biotechnology, a neutralization method using aromatic compounds and a masking deodorizing method.

The following describes an operation of the garbage disposal apparatus. The door 11 is opened to take out the garbage receptacle 2 into which garbage is deposited. The lid 3 is then closed, and thereafter the garbage receptacle 2 is installed in the shielding container 1. Then the door 11 is closed. Now the disposal apparatus is prepared for a drying operation by heating. The microwave oscillator 4 is switched on, directing microwave radiation into the shielding container 1 to heat the garbage. Simultaneously, both the ventilation fan 5 and the suction fan 16 are started. Since the moisture contained in the garbage absorbs the microwave radiation well, the garbage rapidly rises in temperature, and the generation of vapor is started. Since the heat insulating property of the garbage receptacle 2 is excellent, heat loss is minimized and efficient vaporization is achieved.

In this embodiment, the garbage receptacle 2 is made of heat resisting plastic material which permits the microwave radiation to transmit therethrough. Alternatively, the garbage receptacle 2 may be made of a metal or the like which has a microwave shielding capability. Also, a vacuum insulating metal container may be used for the receptacle 2. In such a case, however, the lid 3 should be formed of a material having, as its main component, microwave transmittable material. Vapor generated from the garbage is exhausted out into the condensation space 21 via the vapor exhaust holes 2*a*. In the meantime, the wall of the shielding container 1 is cooled from the outside toward the inside thereof by cooled air fed by the ventilation fan 5, and the generated vapor is condensed into water drops on the inner surface of the shielding container 1. In this embodiment, air cooling is employed. Alternatively, water cooling may be employed by arranging water piping around the shielding container 1. Such a piping arrangement drains water; since this drained water is hot and clean, this may be reused for other purposes. Condensed water developed on the inner surface of the shielding container 1 is then routed to the drainage tube 7 via the funnel 8. In this manner, the garbage is dried and the moisture included therein is removed from the garbage.

In the course of the drying operation, along with vapor, a small concentration of odors may also be generated in the form of gas. Odorant gases generated from the garbage are drawn in via the suction tube 15 branched off the drainage tube 7, by the suction fan 16, and reach the deodorizing device 17. The deodorizing device 17 substantially deodorizes the gases, and deodorized gases are exhausted through the exhaust pipe 18. Thus, the exhaust gases are practically not odorous. In order to help the oxidation catalyst to work in a smooth manner, it is acceptable to provide the suction fan 16 with a suction structure which draws in a small amount of ambient air.

Figure 2:
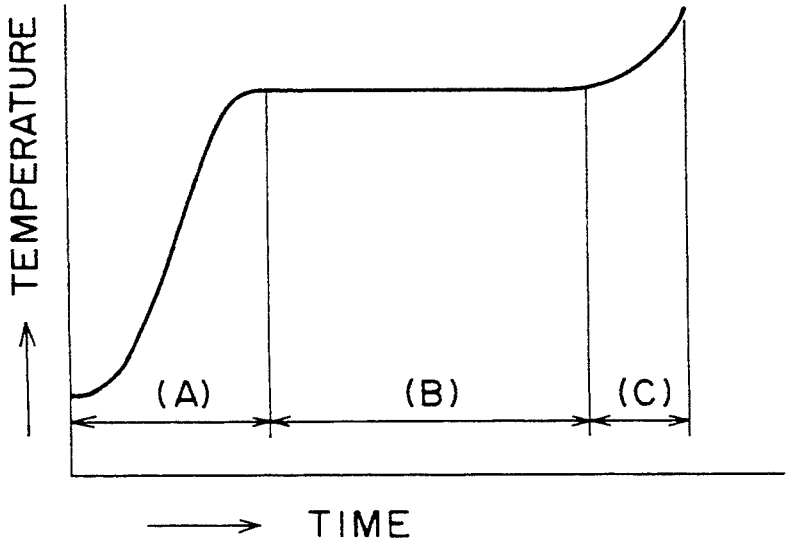
FIG. 2 is a graph showing temperature rise as a result of continuous microwave heating in the course of a drying operation carried out by the apparatus of FIG. 1.

FIG. 2 shows temperature rise with respect to time, wherein temperature data is obtained by heating the garbage under a continuous microwave radiation and the temperature is detected under the atmosphere inside the garbage receptacle 2 when the vapor mass is flowing out of the vapor exhaust holes 2*a* defined in the garbage receptacle 2, in the course of the drying operation. If the garbage receptacle 2 has a poor heat insulating capability, any variations in microwave input power, cooling air temperature or cooling air rate will unpredictably affect the detected temperature level, and will cause a temperature difference between one temperature detected in the atmosphere inside the garbage receptacle 2 and another temperature detected in the exhaust vapor. Such inconsistent temperature data cannot be used to control the drying operation to end it in a timely manner. If the garbage receptacle 2 has a good insulating capability, however, the atmosphere temperature inside the receptacle 2 and the exhaust vapor temperature consistently agree with each other. Either of the two temperatures can thus be considered as the temperature of the garbage, and can be used to control the drying operation to end it in a timely manner.

As seen from FIG. 2, the temperature raising process is divided into three phases: an initial rising phrase (A), a middle rising phase (B) and a final rising phase (C). In the initial rising phase (A), the microwave radiation causes the garbage to rapidly rise in temperature from the ambient temperature. In the middle phase (B), moisture included in the garbage is actively vaporized, and thermal balance is maintained between heat generated by the microwave radiation and heat required for vaporization. Throughout this phase (B), the temperature is kept at about 100° C., i.e., the boiling point of water under atmospheric pressure. In the final rising phase (C), the moisture component in the garbage is decreasing. As a result, solvent density with respect to residual moisture within the garbage is increasing, thereby raising the boiling point of the moisture component. Furthermore, the ratio of the microwave radiation absorbed by non-moisture constituents ( organic substances such as cellulose) of the garbage to the microwave radiation absorbed by residual moisture is increased. These effects are combined to raise the temperature of the garbage.

If the microwave radiation is continuously applied, organic substances in the garbage will be decomposed by heating, most probably leading to firing. Therefore, the drying operation is expected to be successfully completed with the garbage sufficiently dried if the microwave heating is terminated when a temperature rise is monitored during the final rising phase. A possible risk of decomposition and subsequent firing is thus avoided.

If the microwave radiation is intermittently directed to a good insulating receptacle 2, the receptacle atmosphere temperature detected by the temperature sensor almost agrees with the temperature curve illustrated in FIG. 2, but the exhaust vapor temperature does not agree. Output of the exhaust vapor naturally stops each time the microwave radiation application stops. When the temperature is detected in the condensation space 21 at this moment, a slight drop in temperature results. When the microwave radiation is applied again, the vapor is again exhausted, allowing the exhaust vapor temperature to be detected. The detected temperature will rapidly return to the one detected immediately before the application of the microwaves stopped.

Thus, the temperature variation matter is overcome by using a mechanism to monitor temperature only during periods when the microwave radiation is applied. The drying operation is preferably stopped at a threshold temperature of about 120° C. If the threshold is set to a temperature lower than about 120° C., the drying operation may be incomplete. If the threshold is set to a temperature higher than about 120° C., there may be a risk of decomposition and subsequent firing. When subjected to a temperature rise up to this threshold level, the garbage has a moisture content of about 20% or less and a water activity of 0.6 or less. Since almost no microorganism can afford to act under this water activity level, decaying activity is unlikely in the garbage dried as described above.

It is perfectly acceptable for a bag to be set in the garbage receptacle 2 before the garbage is deposited into the garbage receptacle 2. If the garbage is then put into the bag, removal of the garbage will be easier.

A mechanism may be provided to link the suction fan 16 with the front door 11 so that the suction fan 16 operates simultaneously with opening of the front door 11.

In this embodiment, the temperature sensor is provided on the left side of the disposal device in the horizontal direction. Alternatively, it may be provided at the top or the bottom of the shielding container 1 in the vertical direction. Moreover, the temperature increase rate in the initial rising phase of the heating and drying operation depends on the heat capacity of the garbage to be heated. This suggests that the temperature increase rate allows the amount of garbage to be estimated. Given the amount of garbage and the heating capacity derived from the microwave power, a time required to complete the drying operation may be predicted. Using such information, the temperature sensor may be effectively used to control the drying operation.

As detailed above, the garbage disposal apparatus according to the present embodiment operates such that the drying operation is terminated at the moment when a predetermined threshold temperature is exceeded by a temperature detected in the atmosphere inside the garbage receptacle or a temperature of the vapor pushed out of the garbage receptacle, in the final temperature rising phase of the drying operation. The garbage disposal apparatus according to the present invention is capable of drying and reducing a volume of garbage in a reliable manner, without risking garbage firing or the like. As a result, once garbage is dried in the garbage disposal apparatus, decaying of the garbage while being stored is thereafter avoided, and no foul smells are given off.

Furthermore, the drying operation reduces the weight of the garbage, thereby reducing the workload required to manually handle the garbage and transport the garbage to a local garbage station. Furthermore, dried garbage emits no smelly water drops, which would be a secondary source of foul odor. The resulting light-weight garbage provides other advantages related to its handling thereafter.

Embodiment 2

Figure 3:
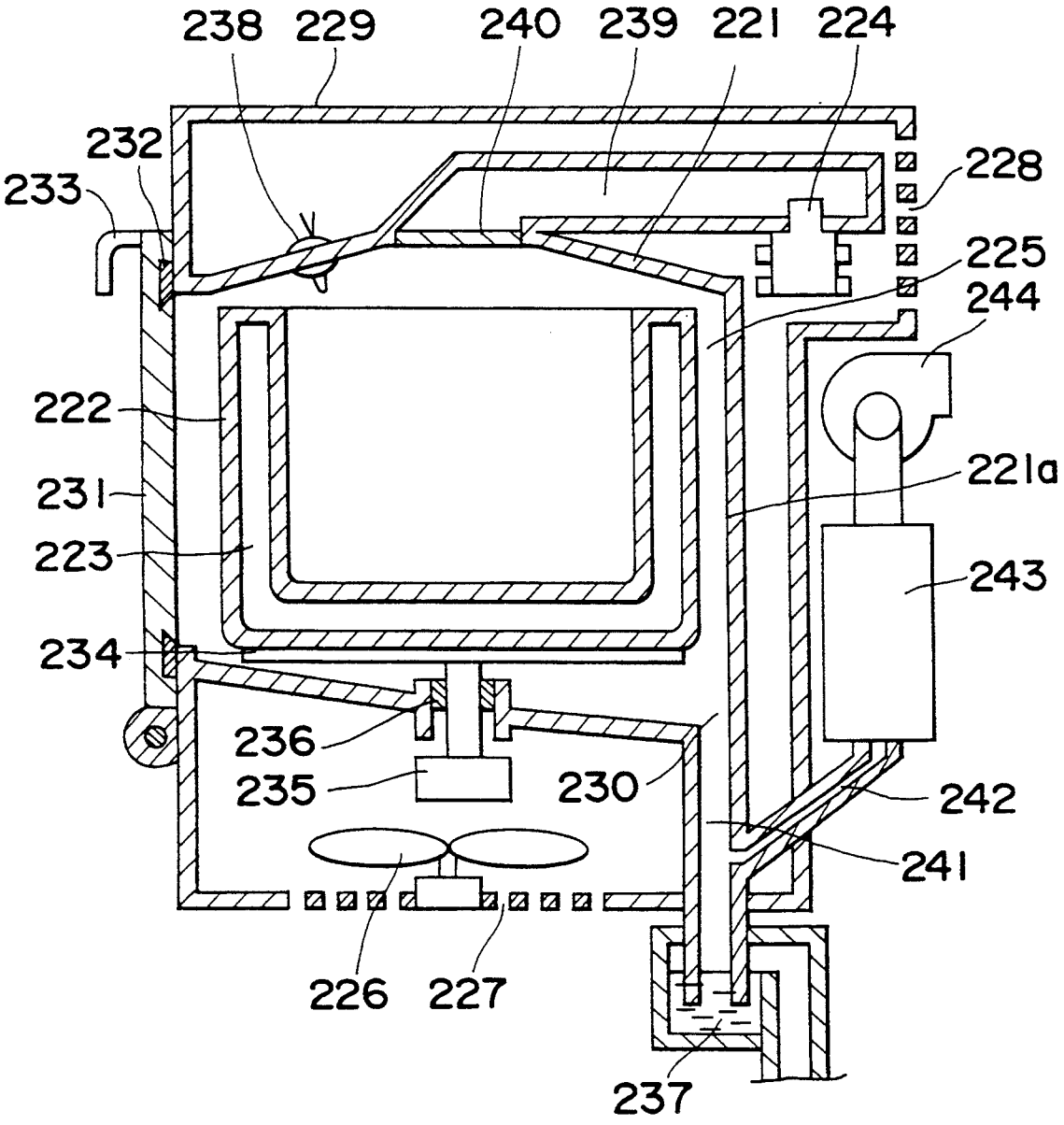
FIG. 3 is a main-part longitudinal sectional view of a dry-processing apparatus according to a second embodiment of the invention.

FIG. 3 shows a main part of a second embodiment of the present invention. Designated by reference numeral 221 is a shielding container composed of a microwave-shielding material, the interior surface of which is composed of an aluminum alloy which is a good heat-conducting material and allows the container to be utilized as a condenser as well as for preventing microwaves from leaking outside. The interior surface of the container 221 is also coated with a fluorinated resin to prevent dirt from the condensate from sticking to the surface. Designated by numeral 231 is a door also composed of a microwave-shielding material and which can be opened forward, so that the shielding container 221 and the door 231 together form a microwave-shielding space. While the door 231 is provided for inserting and removing a garbage container 222 in which garbage is disposed, a different construction can be considered in which the door 231 serves as a front panel which can be removed together with the garbage container 222, or another construction can be considered in which the upper portion of the front panel is drawn to tilt the panel. Designated by numeral 232 is an air-tight packing attached to the door 231, and numeral 233 is a handle for opening and closing the door 231.

The garbage container 222 installed in the shielding container 221 is constructed with a double-wall structure made of a microwave-shielding metallic material, thereby constituting a vacuum heat-insulating container having its hollow portion evacuated to an approximately vacuum condition. Other constructions of the heat-insulating container made of microwave transmittable and heat resistant (foaming) plastic materials or ceramic based materials, or their composite materials can also be considered. However, use of the vacuum heat-insulating container made of metallic material described above is advantageous due to its heat-insulating property, durability, and the like.

It is also possible to provide an inner lid on the garbage container 222. A microwave-transmittable material should be used for the inner lid, and a drain port for the water vapor should also be provided. Since the garbage container 222 is constructed so that it can be removed from the shielding container 221, it is convenient for washing the container itself or dirt inside of the shielding container 221. It is effective, in terms of freeness from dirt and convenience in cleaning, for the portions, such as the interior of the shielding container 221 and the surface of the garbage container 222, with which the garbage or moisture generated from the garbage is liable to make contact to have been previously coated with a fluorinated resin.

Designated by reference numeral 234 is a turntable to improve uniformity of heating, numeral 235 is a drive motor to rotate the turntable 234, and numeral 236 is a hermetic shaft seal. Designated by numeral 224 is a microwave generator for generating microwaves and heating the garbage through an irradiation window 240 composed of a microwave-transmittable material. The garbage contained in the garbage container 222 is heated by irradiating microwaves into the shielding container 221 through a wave guide 239. A water vapor flow path 225 is defined between the shielding container 221 and the outer wall of the double-wall structure of the garbage container 222. A drain port 230 is provided at a lower portion of the shielding container 221, and the drain port 230 is connected to a drain ditch via a drain tube 241 and water-proofing part 237. It is noted that the apparatus may be made portable by providing a condensate reservoir on the downstream side of the drain port 230.

Designated by reference numeral 226 is a cooling fan to feed cooling air to a space between an outer casing 229 and the shielding container 221 and to condense water vapor by cooling the shielding container 221. Designated by numeral 227 is an air suction port, and numeral 228 is an air exhaust port. The cooling fan 226 is also used for cooling the microwave generator 224. Designated by numeral 244 is a suction fan to be used to draw in and exhaust the generated gas during the drying process via a branched tube 242 branched from the drain tube 241, and numeral 243 denotes a deodorizer. The components 241244 244 form an exhaust path. Only a minimal suction-exhaust capacity is required of the suction fan 244 since most of moisture generated from the garbage is condensed and discharged and only a small amount of odor is generated during the processing. While a method using an oxidation catalyst (with a heater) is employed in this embodiment for the deodorizer 243, it is noted that other methods can also be applied.

Designated by numeral 238 is a detector for detecting a temperature of the water vapor to detect the degree of dryness of the heated garbage, and it is used to determine the termination time of the processing by detecting the temperature of the water vapor which shows a time-dependent change in accordance with the progress of the drying of the garbage. The temperature of the water vapor is an indicator here for detecting the degree of dryness. Although other detecting methods can be employed, the method for detecting the temperature of the water vapor is advantageous in that it enables a reliable and inexpensive construction.

The following describes the operation of the apparatus according to the second embodiment.

First, the door 231 is opened to remove the garbage container 222 in which garbage is placed. The garbage container 222 is then placed in the shielding container 221 and the door 231 is closed. Heating of the garbage is subsequently started by turning on the microwave generator 224 and irradiating the microwaves into the shielding container 221. Operation of the cooling fan 226, suction fan 244 and turntable 234 are also started at the same time or after appropriate increase of the temperature of the garbage. The temperature of the garbage increases rapidly because moisture included in the garbage absorbs the microwaves well, thereby starting generation of the water vapor.

The improved heat-insulating property of the garbage container 222 is effective for generating the water vapor efficiently (improvement in heating efficiency). While the shielding container 221 is filled with the water vapor generated from the heated garbage, the water vapor is cooled and condensed on the interior surface of the wall of the shielding container 221 since the wall face of the shielding container 221 is cooled from outside by the air sent from the cooling fan 226. Therefore, a condensing section is formed on the interior side wall 221*a* of the shielding container 221 and the water vapor flow path 225 is also formed between the shielding container 221 and the outer wall of the garbage container 222. When the moisture condensed at the upper portion of the shielding container 221 drops in the garbage container 222 forming water drops, an excessive input of heating energy for the water drops is required, which causes a heat loss. Therefore, the upper portion of the shielding container 221 is constructed with a slope so that water drops move smoothly along the wall face to flow through the water vapor flow path 225. It is also possible to construct a condensing section by forming a water vapor flow path (pipe-shaped, for example) communicating with the interior of the shielding container 221, and cooling a portion of the vapor to be condensed. The above-mentioned construction is, however, more advantageous because a compact arrangement of the entire apparatus is made possible.

Although an air-cooling method is employed here, a water-cooling method is also possible by attaching a water-flow tube directly to the shielding container 221. The system can be constructed such that drain water is utilized as warm water. The apparatus is constructed so that the water condensed at the condensing section 221*a* on the interior wall of the shielding container 221 is collected at the drain port 230 and flows into the drain tube 241. A condensate reservoir is provided on the downstream side of the drain port 230, and the reservoir can be removed to discharge the condensate when it is filled with a sufficient amount of water. This construction enables the apparatus to be used as a portable one.

The drying operation of the garbage proceeds in this way and moisture is separated. A small amount of gaseous odor generated in the above drying process is, together with water vapor, sucked by the suction fan 244 via the branched tube 242 from the drain tube 241, and the gas is sent into the deodorizer 243. The gas is made almost odorless since it is exhausted outside the apparatus after being deodorized in the apparatus described above. A construction in which a small amount of environmental gas (an open air) is introduced by using the suction fan 244 is also effective to allow the oxidative deodorizing reaction to proceed smoothly.

The garbage is directly placed into the garbage container 222 and treated in this process. If a bag is attached in the garbage container 222 prior to placing the garbage into it, the operation is easy because the garbage can be removed together with the bag after being processed. Addition of a mechanism to couple the operation of the suction fan 244 with opening of the door 231 can prevent unpleasant odor from leaking to the operator side when the door 231 is opened, thereby eliminating an unpleasant feeling when the door 231 is opened.

The height of the entire apparatus can be reduced by a construction in which the garbage container 222 can be inserted and removed from the outwardly opening door 231, which allows the apparatus to be installed below a kitchen sink which is considered to be the least usable place in the kitchen. Since the garbage is mainly generated around the sink, installation of the apparatus below the sink places the apparatus at the nearest place to where the garbage is generated, resulting in improved ease of operation and convenience.

Use of a vacuum double-wall structure of a heat-insulating container made of a metallic material is effective as described above. It is difficult to heat the portions of the garbage which are located near the metallic walls in the garbage container 222 because the electric field strength of the microwaves irradiated into the metal container is extremely weakened near the metallic walls. It is particularly difficult to heat the bottom portion of the garbage container 222 due to the fact that microwaves are hardly permeable there. It is effective to keep the garbage away from the metal wall (especially at the bottom) to improve this situation.

Figure 4A:
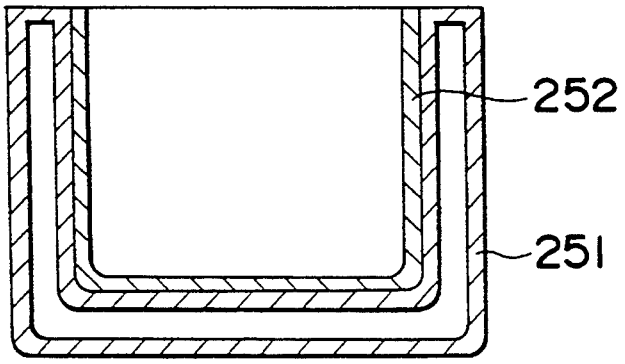
FIGS. 4*a* through 4*c* are main-part longitudinal sectional views, each showing alternative examples of the FIG. 3 embodiment.
Figure 4B:
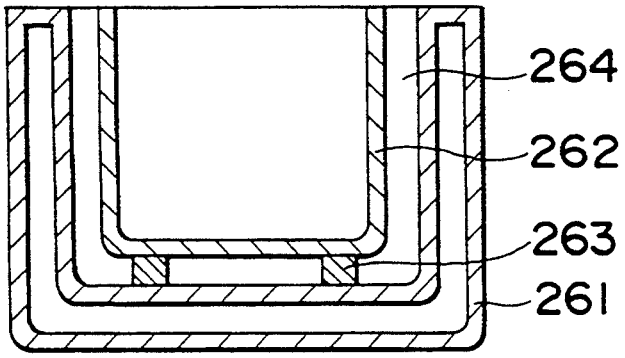
Figure 4C:
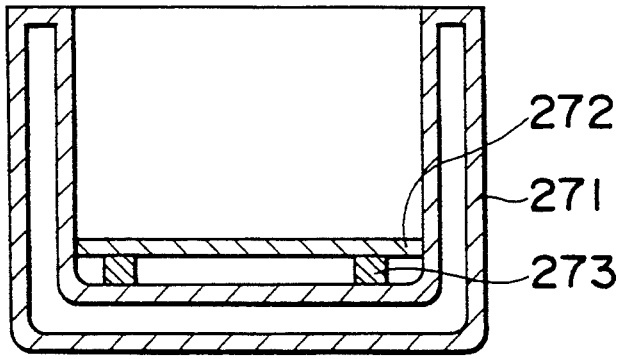

FIGS. 4*a* through 4*c* show concrete examples of garbage containers in longitudinal sectional views. In FIG. 4*a*, a garbage container is constructed by installing an inner container 252 composed of a microwave permeable material in the vacuum heat-insulating container 251 made of metal with the former in contact with the latter. FIG. 4*b* shows another example of a garbage container in which an inner container 262 composed of a microwave permeable material is attached in the vacuum heat-insulating container 261 made of metal via a space 264, wherein a leg 263 maintains a space between the bottoms of the containers 261 and 262. Another example of a garbage container is shown in FIG. 4*c* in which a base seat 272 composed of a microwave permeable material (having legs 273) is provided at the bottom of a vacuum heat-insulating container 271 made of a metal. These constructions allow the garbage to be dried by more uniform heating.

According to the second embodiment of the present invention, it is possible, as described above, to provide an apparatus for processing garbage having a very simple construction, which is easy to operate without creating pollution and which can be readily installed. As a result, the apparatus capable of, for example, preventing the garbage from putrefying or generating unpleasant odors in storage, saving labor in transferring the garbage to the deposit station by reducing its weight, and preventing secondary odors from being generated by eliminating moisture leakage during transfer and by reducing the bulk of the garbage.

Embodiment 3

Figure 5:
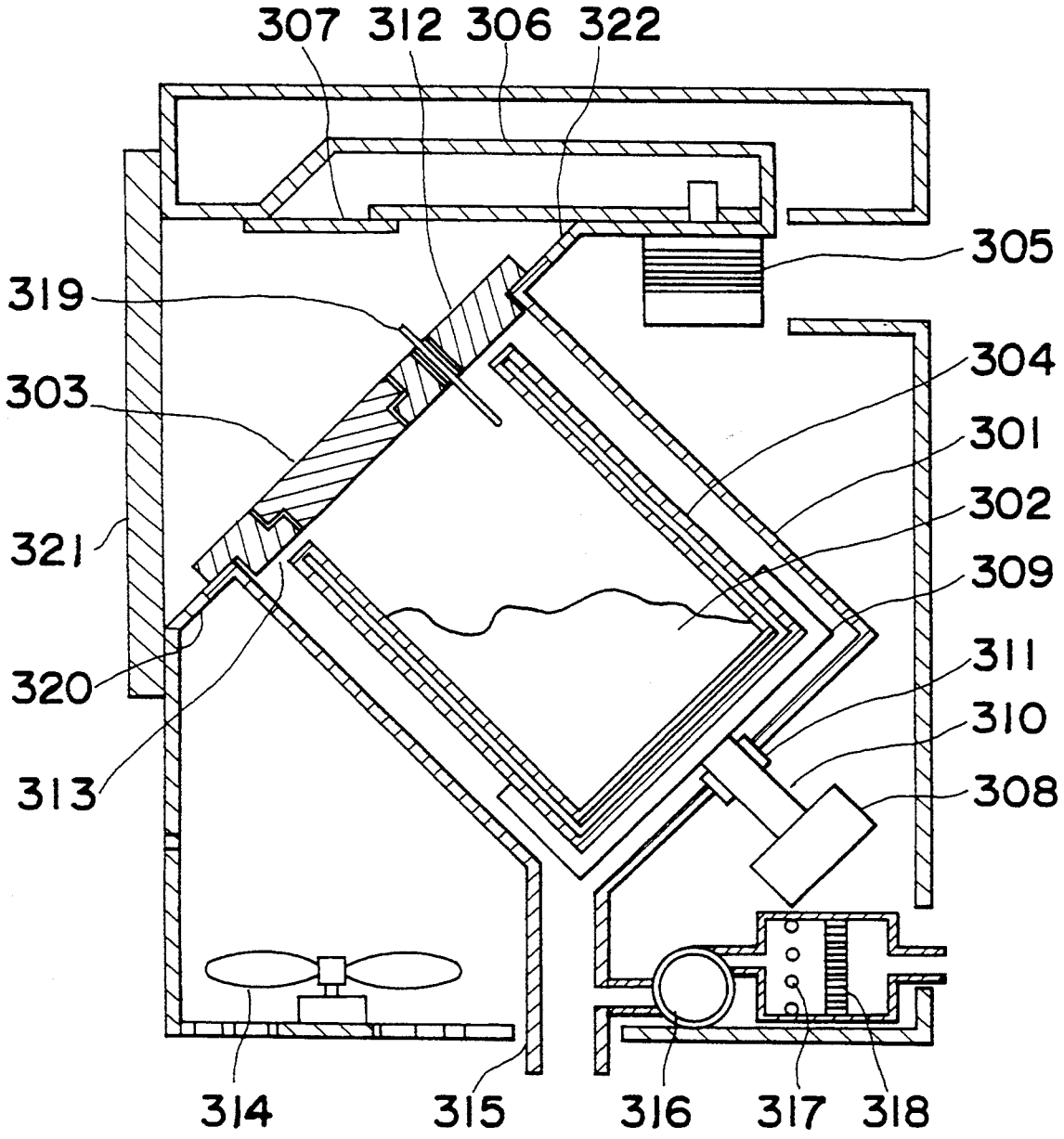
FIG. 5 is a sectional view showing a third embodiment of a dry-processing apparatus according to the present invention.

A third embodiment of the present invention is described below with reference to FIG. 5. Referring to FIG. 5, designated by reference numeral 301 is a microwave reflecting condensing container. An object such as food or garbage 302 to be dried is put into a rotating receptacle 304 through a door 303. The rotating receptacle 304 may be of a double-walled vacuum-gap receptacle made of stainless steel or a heat insulating receptacle made of heat-resisting foamed material. A microwave oscillator 305 generates microwave radiation which is then routed via a wave guide 306 and an opening 307 to the rotating receptacle 304 in which a strong electromagnetic field is to be formed. The rotating receptacle 304 is supported by a rotating table 309 which is driven by a motor 308. A rotating shaft 310 is rotatably supported, via a sealed bearing 311, by the bottom portion of the condensing container 301.

The door 303 of the rotating receptacle 304 is fitted in a lid 312 secured on the top of the condensing container 301. A gap 313 is formed between the lid 312 and the top edge of the rotating receptacle 304 and allows the condensing container 301 to communicate with the interior of the rotating receptacle 304. A ventilation fan 314 is provided to cool the exterior surface of the condensing container 301. A drain pipe 315 is connected to the bottom of the condensing container 301 to drain condensed water into a local drainage system. Non-condensed gas is sucked by a suction fan 316, and is fed to a catalyst 318 with a heater 317, both of which serve to oxidize odorant constituents to be emitted. A temperature sensor 319 is fitted on the top portion of the lid 312 to detect the vapor temperature. Part of the air driven by the ventilation fan 314 is circulated through a ventilation hole 320, fed into a space enclosed by a microwave sealing door 321 and the lid 312 of the condensing container 301, and exhausted to the ambient air through a ventilation hole 322.

The following describes the operation of the third embodiment of the present invention. The garbage 302 is dropped into the rotating receptacle 304 via the door 303. The microwave oscillator 305 is then switched on, directing the microwaves of 2450 MHz through the wave guide 306 to the rotating receptacle 304 where a strong electromagnetic field is generated. The microwave radiation is reflected by the metal wall, and most of the microwaves are absorbed by the moisture content of the garbage 302. The microwave radiation penetrates the garbage from above and attenuates on the bottom portion of the garbage. Furthermore, the electric field intensity is weak at the bottom portion of the metal receptacle 304, and the garbage 302 may be dried in a non-uniform manner. To overcome this disadvantage, the rotating shaft 310 is driven by the motor 308 around a tilted axis. Therefore, the rotating receptacle 304 rotates in the manner of a concrete mixer. The garbage 302 is uniformly dried due to the rotation thereof caused by rotation of the receptacle 304.

Vapor is pushed out of the receptacle 304 into the condensing container 301, via the gap 313. Since the metal wall of the condensing container 301 is cooled by air fed by the ventilation fan 314, the vapor is condensed into water to be drained down to the drain pipe 315. Since the garbage is uniformly heated, the drain water contains little organic substance such that the local drainage system is not contaminated by organic substance. Non-condensed vapor contains a slight amount of gas caused by decomposition of the garbage 302, and the catalyst 318 along with the prewarreed heater 317 oxidizes the non-condensed vapor to form an odorless exhaust.

Condensation of vapor is needed for the following reason. If excess vapor is developed, some of the vapor is likely to condense at the drain pipe 315 and the suction fan 316. The condensed water lodging in such a place will eventually damage the structure in which the heat-drying apparatus is installed. The catalytic reaction rate is dependent on the dwell time of any gas in the catalyst 318. When vapor advances fast, odorant gases pass the catalyst 318 fast as well with smaller chance of catalytic reaction.

In this embodiment, vapor is condensed into water to reduce the volume of emitted gases, and thus, longer dwell time is allowed. Along with condensation of the vapor, a great deal of odorant constituent is condensed, thus alleviating the deodorization load on the catalyst 318.

The receptacle 304 is rotated around the tilted axis, as already described. Then, the garbage 302 rotates inside the receptacle 304, transferring heat to the rotating receptacle 304. This heat transfer is easier than when the garbage 302 remains stationary. Heat transfer to the exterior of the rotating receptacle 304 again heats the vapor in the condensing container 301, making condensation there more difficult. In this embodiment, therefore, the rotating receptacle 304 is made of an insulating material in order to avoid transfer of the heat developed in the garbage 302 to the condensing container 301. Conversely, the condensing container 301 is preferably made of high thermal conductivity material to increase the condensation rate. For example, a rotating receptacle made of stainless steel (1 mm thick, SUS430) has a temperature of 80° C. on its exterior, with a condensation ratio (the ratio of an amount of condensed water divided by total vapor) of about 50%. A double-walled, vacuum-gape stainless steel rotating receptacle offers a temperature of 40° C. on its exterior surface with a condensation ratio of 95% such that odorant constituents decrease proportionately, thereby reducing the odor in the drain pathway. A plastic insulating material receptacle falls somewhere between the above two kinds of receptacles in its performance. The double-walled, vacuum-gap, stainless steel receptacle is thus the best receptacle.

Heat transfer from the rotating receptacle 304 to the condensing container 301 causes a needless consumption of the microwave energy. The insulating receptacle 304 serves to reduce electric consumption.

Part of the vapor developed in the rotating receptacle 304 condenses onto the condensation lid 312. In the present embodiment, the lid 312 is tilted, and all condensed water on the lid 312 flows down to the condensing container 301. If water drops fall into the rotating receptacle 304, additional microwave energy is required to evaporate them again. The lid 312 should be inclined, at least in its area facing the opening of the rotating receptacle 304. In this embodiment, although the microwave radiation is used as the heating means, as a simple alternative to this, hot air may be employed. Similar effects may be obtained if the hot air is blown into the rotating receptacle 304.

The progress of the drying operation is monitored by the temperature sensor 319 fitted on the top of the rotating receptacle 304. The progress may also be monitored by a detecting means for detecting changes in weight of the garbage 302 or a detecting means for detecting changes in temperature in the condensing container 301. Based on these signals, the microwave radiation may be terminated before overheating takes place or electric power is excessively consumed.

The heat-drying apparatus according to the third embodiment of the present invention allows an object to be uniformly dried and made resistant to decay. With less power consumption, the heat-drying apparatus reduces the object in volume as well as weight. Since condensed water contains a small amount of organic substance, the drainage system is not contaminated. Odor emission is minimized because most of vapor developed is condensed.

Embodiment 4

Figure 6:
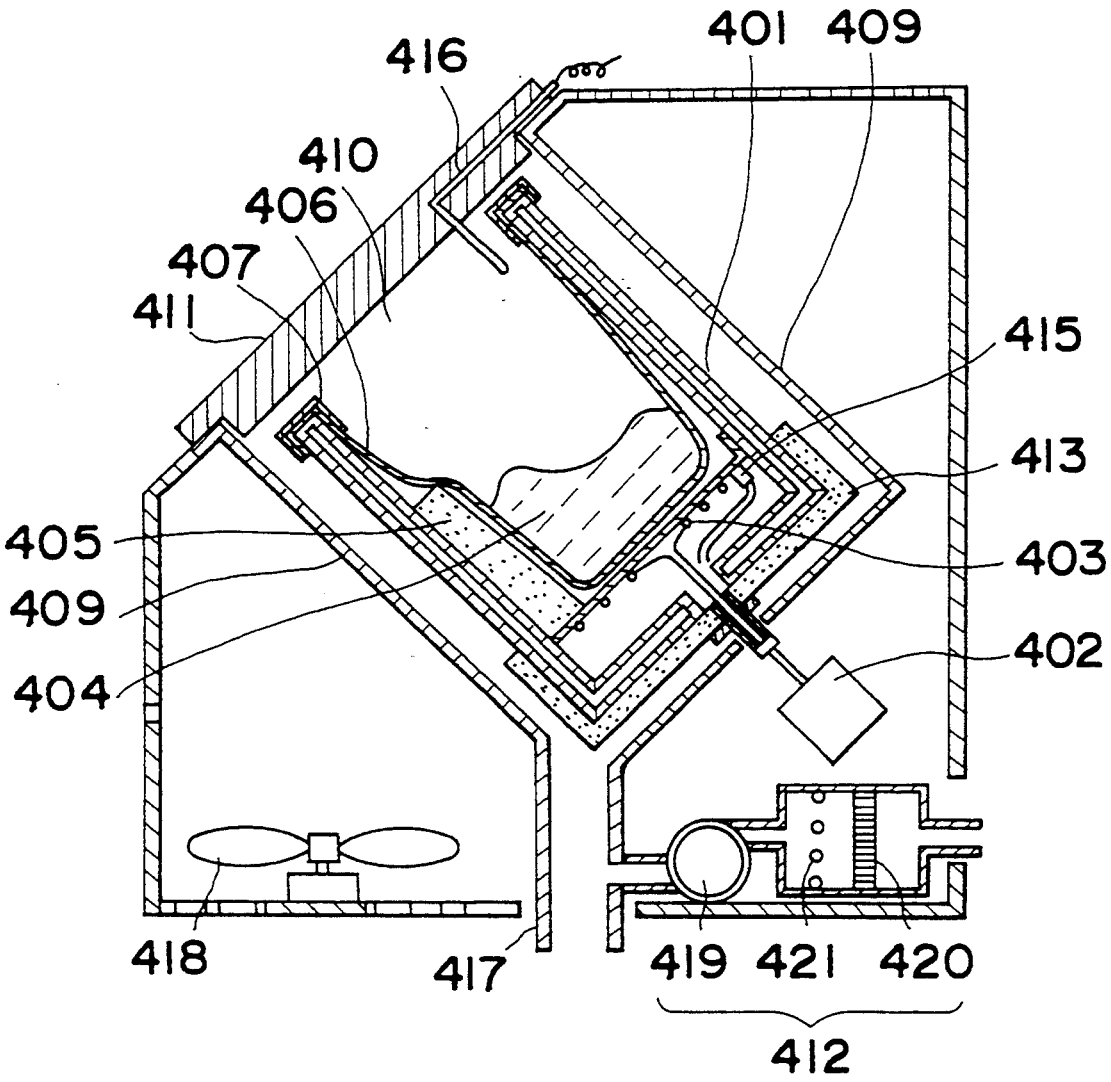
FIG. 6 is a sectional view of a dry-processing apparatus according to a fourth embodiment of the present invention.

A fourth embodiment of the present invention is now described below referring to FIG. 6.

The present embodiment is characterized in that a protruding section 405 made of tetrafluoro-ethylene is provided at a side wall of the interior of the rotating container 401 which is provided in a slanted condition. Also provided in contact with the protruding section 405 is a bag 406 made of polyethylene having a softening temperature of 100° C. for accommodating raw garbage (objects to be dried) 404 therein. In this embodiment, the bag 406 is attached to the opening of the rotating container 401 by using a ferrule 407 so that the bag 406 will not slip down. In this arrangement, when the raw garbage 404 is heated up to 100° C by energizing a heater (heating means) 403 while the rotating container 401 is rotated by the driving motor 402, the raw garbage 404 is heated in close contact with the rotating container 401 via the bag 406 and is dried as it peels from the bag 406. At the last stage of the heat-drying, the raw garbage 404 aggregates in the bag 406 to form a lump. Therefore, the raw garbage 404 is prevented from sticking to the rotating container 401 and the dried objects from the raw garbage can be easily removed from the bag 406. Moreover, the bag 406 will not become twisted by virtue of the presence of the protruding section 405.

The present embodiment is further characterized in that a condensing section 409 is provided outwardly of the rotating container 401, a lid 411 is provided at the opening of the condensing container 409, and a deodorizing section 412 is provided in the vicinity of an end of the condensing container 409. The function and effect of the heat-drying apparatus of the present embodiment are described below.

The rotating container 401 of the present embodiment is a vacuum container having a double wall with a view to enhancing the heating efficiency, and a heat-insulating material 413 is provided in the vicinity of the heater 403. In the rotating container 401, the raw garbage 404 to be dried by heating is accommodated in the bag 406 made of polyethylene terephthalate (PET) having a melting point of 250° C. The raw garbage 404 is heated up to 100° to 200° C. by energizing the heater 403 while the rotating container 401 is rotated by the driving motor 402. The temperature of the rotating container 401 and that of an upper portion thereof are measured by temperature detecting members 415 and 416, respectively, during the heating, and the progress of the drying process is determined by measuring their time dependent changes. When the raw garbage 404 is heat-dried with the above-described arrangement, heating efficiency will not be reduced since the raw garbage 404 is dried while in contact with the rotating container 401 via the bag 406. Moreover, the raw garbage 404 is dried as it is peeled from the bag 406 by impact force of the rotation. Then at the final stage of the heat-drying, the raw garbage 404 is formed into a lump in the bag 406, so that the raw garbage 404 is prevented from adhering to the rotating container 401 and can be easily removed from the bag 406. Water vapor generated by the heating is, on the other hand, condensed at the condensing container 409 and then discharged to the drain tube 417. Condensation of the water vapor can be efficiently effected by cooling the condensing container 409 by using an air blower 418.

Further, cracked gas from organic substances may be generated when the raw garbage is heated. Therefore, the cracked gas from organic substances is sucked into the deodorizing section 412, and the gas is deodorized by oxidizing it with an oxidation catalyst to form carbon dioxide gas and water. For that purpose, the deodorizing section 412 is composed of a honeycomb-shaped oxidation catalyst 420 having a hole communicating with a suction fan 419 and a heater 421 to heat the catalyst.

Although the rotating container is rotated in one direction in the embodiments, it may be rotated in both forward and reverse directions.

As apparent from the description above, the following effects can be obtained by the heat-drying apparatus according to the present invention.

(1) Objects can be efficiently heat-dried without being adhered to the interior of the rotating container.

(2) Water vapor and odor will not leak out while the objects are being dried.

Embodiment 5

Figure 7:
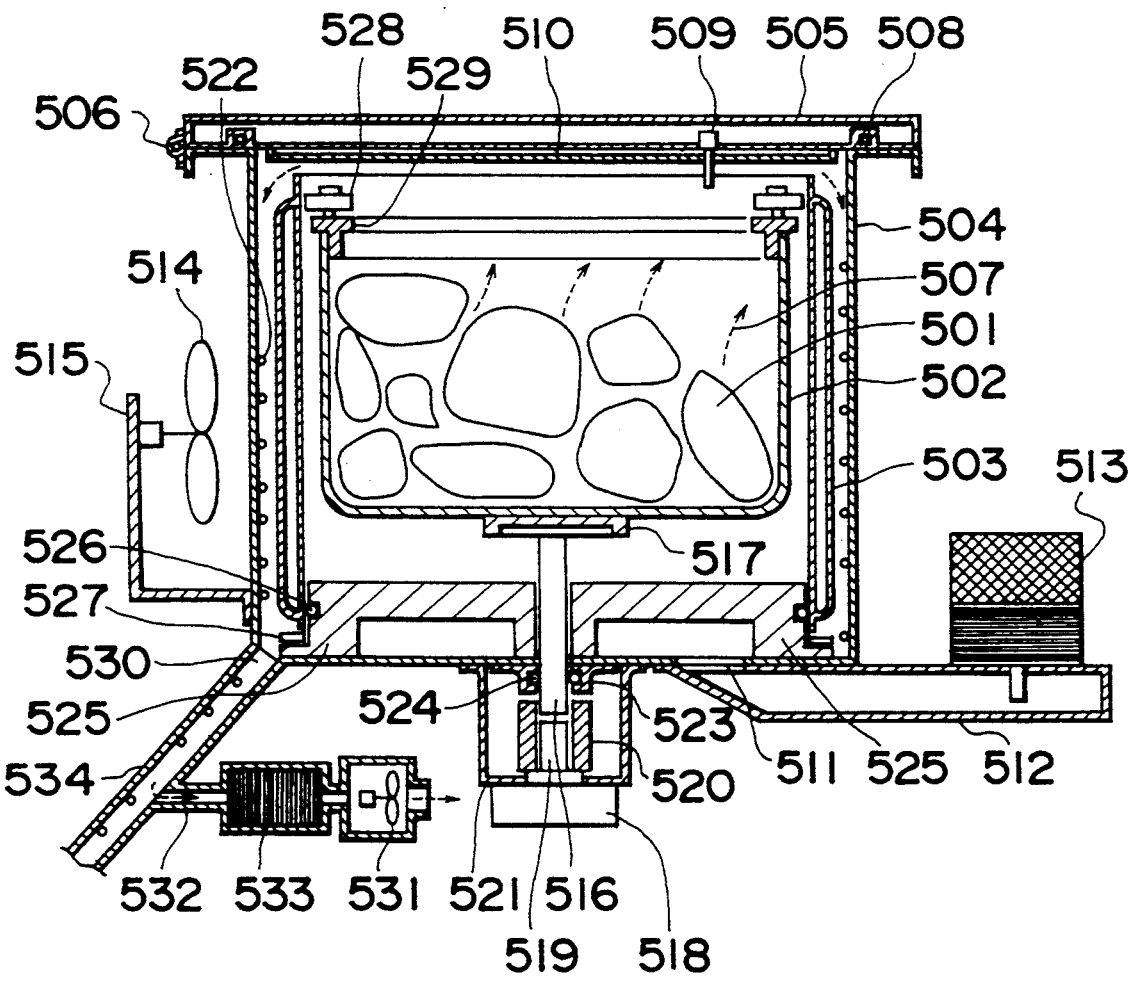
FIG. 7 is a sectional view of a dry-processing apparatus in accordance with a fifth embodiment of the present invention.

FIG. 7 shows a fifth embodiment of a dry-processing apparatus for, e.g., disposing a garbage in accordance with the present invention.

Referring to FIG. 7, a cylindrical heat insulating container 503 is placed outside a drying object accommodating inner container 502 for accommodating a drying object 501, and a condensing outer container 504 is provided outside the cylindrical heat insulating container 503. The drying object accommodating inner container 502 is made of a microwave transmittable material having excellent heat resistance. The adopted cylindrical heat insulating container 503 is a container made of a metal (a microwave reflecting material) whose internal pressure is reduced. Above the condensing outer container 504 is a condensing housing lid 505, the condensing outer container 504 and condensing housing lid 505 each being made of a microwave reflecting material. The condensing housing lid 505 is made openable by means of a hinge 506. The condensing housing lid 505 is provided with a lid packing 508 so as to prevent the possible leakage of vapor 507 generated from the drying objects 501. A temperature detector 509 is provided at the condensing housing lid 505 off to the right so as to detect the temperature of the vapor 507.

Below the condensing housing lid 505 is provided a heat insulating member 510. A microwave inlet 511 is placed at the bottom of the condensing outer container 504 as connected via a wave guide 512 to a microwave generator 513. A wind fan 514 for cooling the exterior of the condensing outer container 504 is mounted to the condensing outer container 504 by means of a wind fan support member 515. In the present embodiment, although the drying object accommodating inner container 502 is inclined by about 45 degrees with respect to the horizontal, the inclination angle can be arbitrarily chosen.

Below the drying object accommodating inner container 502, there are provided a spindle 516, a disconnectable coupling section 517, and a motor 518 for rotating the spindle 516. The motor 518 has a motor shaft 519 to be connected to the spindle 516 via a joint 520. The motor 518 is mounted to the bottom of the condensing housing 504 by means of a motor support member 521. An O-ring 524 is provided between the spindle 516 and a bearing member 523 so as to prevent condensate 522 from leaking toward the motor 518. The cylindrical heat insulating container 503 and the spindle 516 are mounted on a base seat 525, while a packing 526 and a sheet 527 are provided between the cylindrical heat insulating container 503 and the base seat 525. The base seat 525 is made of a microwave transmittable material. A roller 528 is provided as a rotation assistant at an upper portion of the drying object accommodating inner container 502 so that the drying object accommodating inner container 502 can rotate in contact with the inner surface of the cylindrical heat insulating container 503 via the roller 528. At an upper portion of the drying object accommodating inner container 502, there is provided an inner container ring 529 for the purpose of reducing the inner diameter of the drying object accommodating inner container 502. At a lower portion of the condensing outer container 504 is provided a condensate outlet 530 through which gas (including odor) generated from the drying object 501 is drawn by means of a fan 531, and a catalyzer unit 533 is provided in a gas drawing pipe 532. Below the condensate discharge section 530 is provided a condensate discharge path 534.

Reference will now be made to the operation of the dry-processing garbage disposing apparatus. Referring to FIG. 7, after putting the drying object 501 into the drying object accommodating inner container 502, the condensing housing lid 505 is closed. When the microwave generator 513 is made to operate, microwaves pass through the wave guide 512 to be radiated into the condensing outer container 504 through the microwave inlet 511. The microwaves radiated into the condensing outer container 504 transmit through the base seat 525 and the drying object accommodating inner container 502 made of a microwave transmittable material to start heating the drying object 501. The microwaves are selectively absorbed particularly by the moisture in the drying object 501, according to which operation the drying object 501 is gradually dried due to the generation of vapor 507. Since the microwaves are radiated from below the drying object 501, there is no possibility of leaving boiled liquid even when the drying object 50 is garbage, thereby ensuring sanitation. By placing the microwave inlet 511 at the bottom of the condensing outer container 504, the apparatus can be made compact and possible leakage of microwaves from the condensing housing lid 505 can be easily prevented.

Furthermore, the wind fan 514 is made to operate together with the microwave generated 513 to cool the external surface of the condensing housing 504 with air. By cooling the external surface of the condensing outer container 504 with air, almost all of the vapor 507 generated from the drying object 501 is condensed into dew on the internal surface of the condensing outer container 504 so as to form condensate 522 which is discharged through the condensate outlet 530 at a bottom portion of the condensing outer container 504. Since no solid matter which would cause clogging inside the sewer is discharged from the condensate outlet 530, there is no possibility of contaminating the environment.

Furthermore, the motor 518 is operated together with the microwave generator 513 and the wind fan 514 to rotate the drying object accommodating inner container 502 aslant. By rotating the drying object accommodating inner container 2 aslant, the drying object 1 is stirred so that it is uniformly dried and heat transfer is promoted to achieve a high condensation performance for the vapor 507 generated from the drying object 501. By stirring the drying object 501, the drying object 501 can be reduced in volume.

Furthermore, by detecting with the temperature detector 509 an increase in temperature of the vapor 507 generated from the drying object 501 during the dry-processing, the dry-processing operation can be completed without making the drying object 501 catch fire. The gas (including odor) generated from the drying object 501 is made to pass through the catalyzer unit 533 to remove odor, and is thereafter discharged downstream of the fan 531.

By placing the cylindrical heat insulating container 503 outside the drying object accommodating inner container 502, heat radiation from the drying object 501 can be controlled to achieve a high operational efficiency. Generally, by increasing the cooling of the external surface of the condensing outer container 504 to increase the condensing performance, heat loss from the drying object 501 tends to increase. However, due to the provision of the cylindrical heat insulating container 503, condensing performance and high efficiency can be concurrently achieved. By fixing the cylindrical heat insulating container 503 to the condensing outer container 504 and rotating only the drying object accommodating inner container 502 made of a microwave transmittable material, microwaves can be easily radiated from below the drying object and the torque necessary for rotation can be reduced.

By providing the coupling section 517 which can be disconnected from the spindle 516 provided below the drying object accommodating inner container 502, the drying object accommodating inner container 502 can be individually uncoupled. With the above-mentioned arrangement the container 502 and the entire apparatus can be easily cleaned to assure high usability. The roller 528 serves as a rotation assisting member at an upper portion of the drying object accommodating inner container 502 so that the inner container 502 can move in contact with the internal surface of the cylindrical heat insulating container 503 and smooth rotation can be achieved.

By providing the inner container ring 529 which reduces the inner diameter of the drying object accommodating inner container 502 at an upper portion of the drying object accommodating inner container 502, the drying object 501 as effectively prevented from falling out of the drying object accommodating inner container 502.

By placing the microwave inlet 511 diagonally above the center of the spindle 516 of the condensing outer container 504, the microwave inlet 511 and the rotation mechanism are distinctly separated in position to save space and cause uniformity in the microwave radiation irradiating the drying object 501.

By placing the temperature detector 509 for detecting the temperature of the vapor 507 generated from the drying object 501 internally at the condensing housing lid 505 and above the drying object accommodating section, high temperature ascending vapor 507 can be detected to provide a quick detection response.

Embodiment 6

Figure 8:
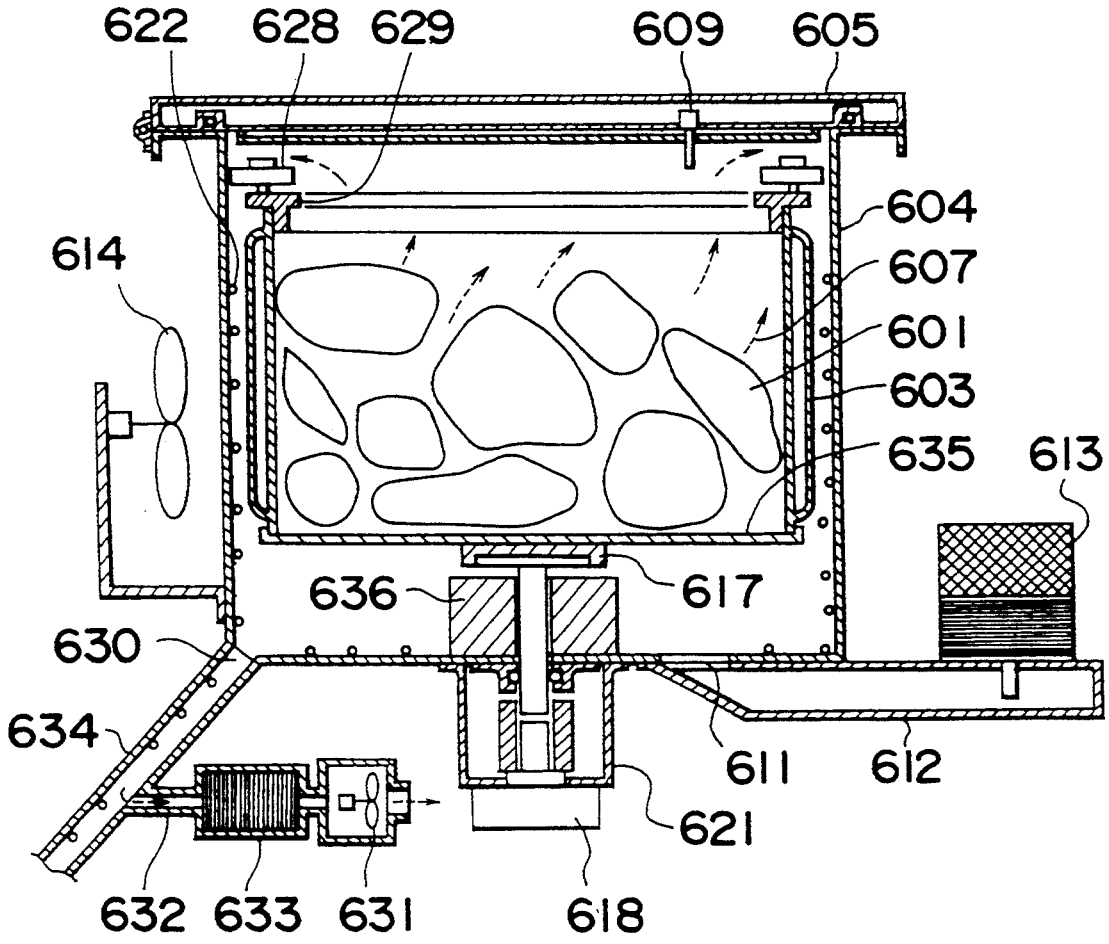
FIG. 8 is a sectional view of a dry-processing apparatus in accordance with a sixth embodiment of the present invention.

FIG. 8 shows a dry-processing apparatus such as a garbage disposing apparatus in accordance with a sixth embodiment of the present invention. This embodiment differs from the fifth embodiment in that the drying object accommodating section is formed as an integrated body of which a cylindrical heat insulating container 603 serves as a side member and a drying object accommodating section bottom 635 made of a microwave transmittable material serves as a bottom member as shown in FIG. 8. A roller 628 is also provided as a rotation assisting member at an upper portion of the cylindrical heat insulating container 603 so that the drying object accommodating section can rotate in contact with the internal surface of the condensing housing 604 via the roller 628. At an upper portion of the cylindrical heat insulating container 603 is also provided an inner container ring 629 so as to reduce the inner diameter of the cylindrical heat insulating container 603. No packing 526 nor sheet 527 is necessary, and a cylindrical block 636 smaller than the base seat 525 of the fifth embodiment is provided instead.

By integrating the drying object accommodating section as one body, the apparatus is able to have a simple construction. Since the cylindrical heat insulating container 3 can be individually dismounted, if dust is attached, the container 3 and the entire apparatus can be cleaned to ensure sanitation.

According to a dry-processing apparatus of the present invention as described above, the following effects can be obtained. By cooling the external surface of the compacting section in the dry-processing stage to condense almost all of the vapor generated from the drying object into dew and then into condensate on the internal surface of the condensing housing, the possible generation of odor in the dry-processing stage can be reduced. By generating the microwaves from below the drying object, even when the drying object is garbage, there is no possibility of leaving boiled liquid at the bottom of the drying object accommodating section, thereby ensuring sanitation and compactness of the dry-processing apparatus. Furthermore, by rotating the drying object accommodating section aslant and also operating the microwave generator and the wind fan, the drying object is stirred so that it is uniformly dried and reduced in volume while heat transfer is promoted. Therefore, a high condensation performance of the vapor generated from the drying object is attained.

Furthermore, by placing the cylindrical heat insulating container outside the drying object accommodating inner container, heat radiation from the drying object can be controlled to enable a high operational efficiency to be achieved. By rotating only the drying object accommodating inner container made of a microwave transmittable material, the torque required for rotation can be reduced.

By integrating the drying object accommodating section in a single body, the dry-processing apparatus is of a simple construction. Since no solid matter which would cause clogging inside a sewer is discharged from the condensate outlet 630 (530 in the fifth embodiment), a clean and sanitary dry-processing can be carried out so as to avoid contaminating the environment. By virtue of dry-processing the garbage with microwaves, no deterioration of the exhaust gas characteristics will occur.

Embodiment 7

Figure 9:
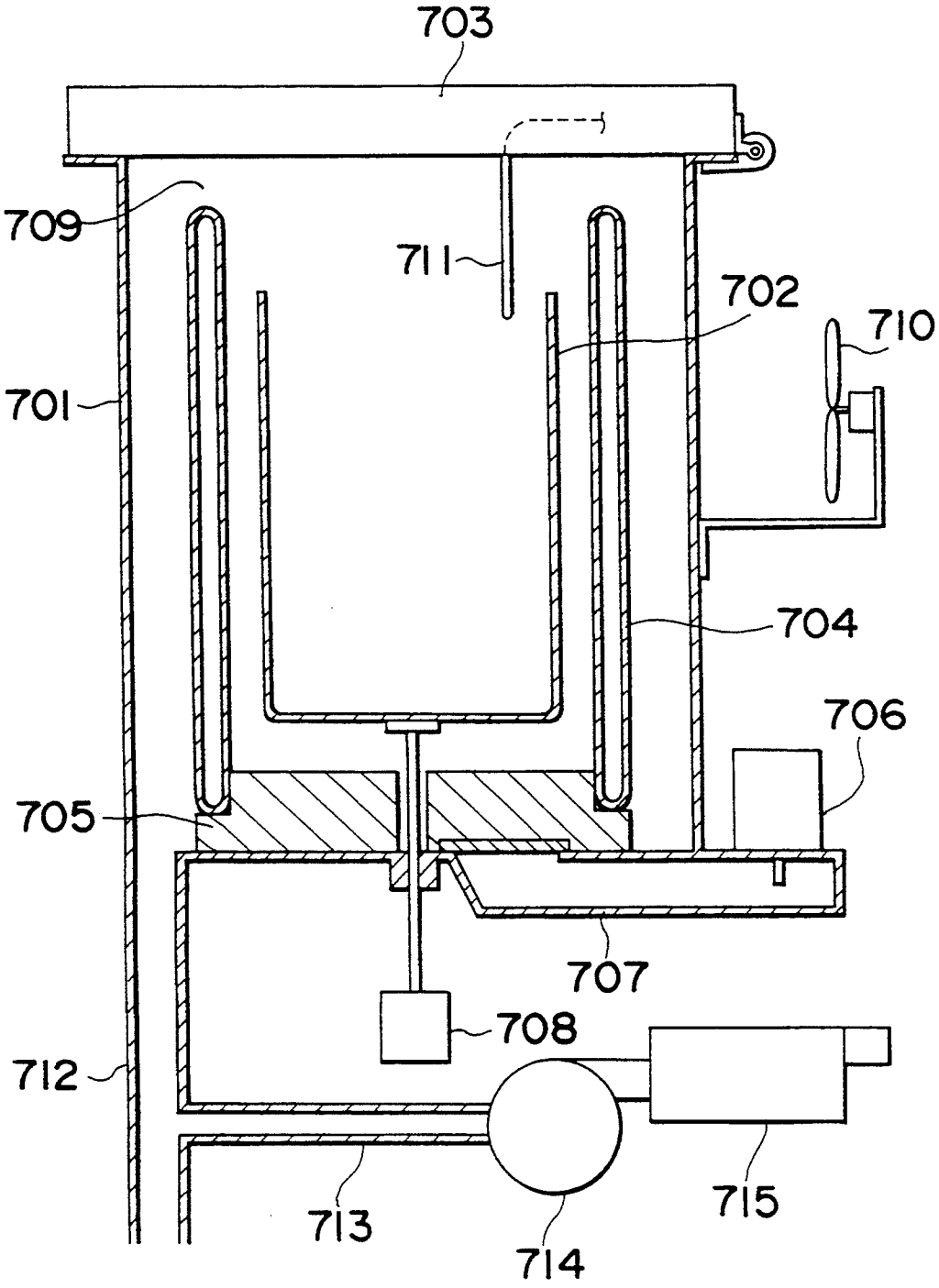
FIG. 9 is a longitudinal sectional view showing a main part of a dry-processing apparatus according to a seventh embodiment of the present invention.

FIG. 9 shows a main-part of a seventh embodiment of the present invention. Referring to FIG. 9, an outer casing which serves as a condensing section, designated by reference numeral 701, also serves as a cylindrical outer casing for shielding microwaves. A garbage accommodating container 702 is installed in the outer casing 701. Reference numeral 703 designates a lid which can be opened insert and remove garbage, and which is securely closed in contact with the top end of the condensing outer casing 701. The lid 703 is formed primarily of a microwave shielding material such as a metallic material so as to have a successful heat-insulating property. Between garbage accommodating container 702 and the condensing outer casing 701, there is provided a heat-insulating barrel 704 having a double wall structure formed of a metal material with vacuum hollow interior. The heat-insulating barrel 704 may also be formed of a foam plastic material, a ceramic-group material, or a heatinsulating material composed of a composite material and a metal, but the vacuum heat-insulation is preferable to any other because it is more compact. The heat-insulating barrel 704 is mounted on a base seat 705 which is made of a plastic heatinsulating material which is microwave permeable.

As a heating device for heating the garbage, a microwave or resistance wire heater can be used, and in this embodiment, a microwave oscillator 706 is used. The microwaves generated by the microwave oscillator 706 are guided to permeate the base seat 705 made of a microwave permeable material via a wave guide 707 so as to be directed to the garbage accommodated in the garbage accommodating container 702. The garbage accommodating container 702 is rotated about a vertical shaft by a motor 708 for uniformly heating the garbage. A passage 709 for vapor generated from the heated garbage is defined by a space between the top edge of the heat-insulating barrel 704 and the bottom surface of the lid 703. The vapor generated from the garbage is condensed by the condensing outer casing 701 cooled by a cooling fan (cooling means) 710. Although an air cooling system is adopted in this embodiment, a water-cooling system may of course be adopted in which water supply tubing is fixed to the condensing outer casing 701, where a further arrangement can be developed so as to utilize the cooling water as warm water.

The heating and drying process should be terminated when the garbage has reached a properly dried state, and it is convenient to provide a proper sensing means for sensing such a state. As an example, in this embodiment, there is provided a temperature sensing means 711. The dry-processing is completed by sensing the temperature of the garbage accommodating container 702 when the drying process has progressed nearly to its end. Other available methods for completing the drying process include a weight sensing method, a humidity sensing method, and a field-strength sensing method for sensing a fieldstrength inside the container, but the temperature sensing method is convenience and inexpensive.

A drain port 712 for draining the condensed water is directly connected to a drainage system. There are further provided a suction fan 714 for drawing gas through a branch tube 713 branched from the drain port 712, and a deodorizer 715 for deodorizing the drawn gas. These components together form an exhaust path, and most of the moisture generated from the garbage is condensed at the condensing outer casing 701 and then drained. Since the amount of odor-components generated during processing is small, the suction fan 714 must provide only a minimum amount of suction force. Also, it is preferable to adopt a system (with ah eater for heating) employing an oxidizing catalyst as the deodorizer 15. However, another system (or systems) can also be selected from among, for example, an absorption deodorization system using an absorption agent of an active carbon series, silica series, alumina series, zeolite series, ion exchange resin series, or the like, an oxidation decomposition system using ozone, a biological deodorization system, a neutralization system using an aromatic, a masking system, and others, depending on the particular requirements.

Next the operation of the seventh embodiment is described hereinbelow. The lid 703 is first opened, garbage is thrown into the garbage accommodating container 702, and then the lid 703 is closed. Thereafter, the process proceeds to a heating operation. The microwave oscillator 706 serving as a heater is switched on to start heating of the garbage. Simultaneously or after allowing a proper time interval for increasing the temperature of the garbage, the cooling fan 710 and the suction fan 714 are started. The temperature of the garbage is gradually increased while vapor starts being generated. It is desirable to enhance the heat-insulating property of the garbage accommodating container 702 with a view to minimizing the heating loss and thereby efficiently generating vapor. In general, portions in proximity to the heating source are readily increased in temperature, while the distant wall surfaces remain low in temperature. However, the heat-insulating arrangement of the present invention results in uniformity of temperature distribution, such that the drying process proceeds uniformly. Also, to achieve uniform drying, it is preferable to carry out the heating operation with a low-power heating source over a long period of time, in which case the power loss due to heat radiation from the garbage accommodating container 702 involved in this heating process can be prevented by the heat-insulating barrel 704, thereby resulting in high heating efficiency.

The vapor generated from the garbage subjected to the heating process flows out through the passage 709. When this occurs, the condensing outer casing 701 is thermally shielded from the garbage accommodating container 702 by the heat-insulating barrel 704 while the condensing outer casing 701 is cooled by the air blown from the cooling fan 710. The generated vapor is accordingly cooled and condensed by the condensing outer casing 701. The vapor gasified at approximately 100° C. contains odor components that will gasify at the same temperature. Therefore, when the vapor is cooled down to room temperature, the proportion of odor components contained in the condensed water is the same as that of the odor components previously contained in the vapor. That is, almost all of the odor generated flows out of the apparatus through the drain port 712 together with the condensed water.

When a condensed water sump is provided downstream of the drain port 712, it is advisable to arrange the sump so that it can be removed, thereby allowing the condensed water to be disposed of when a predetermined amount of water is collected. This arrangement permits the apparatus to be used as a portable appliance.

The small amount of vapor and odor components remaining even after the condensation by the condensing outer casing 701 are drawn through the branch tube 713 by the suction fan 714, transferred to the deodorizer 715, and exhausted to the outside after deodorization by the deodorizer 715, thus resulting in an almost odorless state. To smoothly advance the oxidizing deodorizing reaction, it is effective to draw a small amount of outside air into the deodorizer 715. A substantial decrease in the odor component due to use of the condensed water allows the deodorizer 715 to be reduced in size. Furthermore, since the vapor itself is small in amount, there will occur neither vapor absorption of active carbon nor moisture poisoning of the oxidizing catalyst, such that the deodorization performance is enhanced.

In the heating and drying process, the temperature sensed by the temperature sensing means 711 will be approximately 100° C., which is the boiling point of water, when the moisture included in the garbage is sufficiently large in amount. However, when the boiling point increases as the amount of moisture decreases, the sensed temperature starts to increase. Sensing of this state causes the process to be terminated. If the heating temperature increases too high, heat decomposition of the garbage is accelerated during the heating process, causing more dissipation of organic components, so that the large amounts of organic components are disposed in the condensed water. Thus, excessively high heating temperature will prevent the organic processing from being used for sewage and therefore should be avoided. Accordingly, it is desirable to set the sensed temperature for terminating the processing at a value slightly higher than the boiling point of water (in the range of 100° to 130° C.). In this manner, it is possible to suppress the occurrence of organic components due to thermal decomposition.

The present embodiment has been described with regard to an example using microwaves for heating. However, the same effects can be attained even if a heater controlled to remain at a constant temperature is provided below the garbage accommodating container 702.

In such a case, although a greater drying time is required than with microwaves, the apparatus can be simplified in construction. Further, the heat-insulating barrel 704 may be constructed as a container having a bottom (garbage accommodating container), to which the garbage may be directly inserted.

According to the present invention, it is possible to provide a garbage disposing apparatus having a simple construction as described above, which is capable of efficiently processing garbage to dry it and reduce its weight, which is uniform in its drying performance and generates low levels of odor during processing, and which is small in size so it can be easily installed. As a result, some advantages can be attained: for example, the garbage can be prevented from decomposing or generating foul odors during storage; the burden of conveying the garbage packs to collecting places is reduced by reducing their weight; and moisture leakage during conveyance can be eliminated, preventing the occurrence of secondary odor.

Embodiment 8

Figure 10:
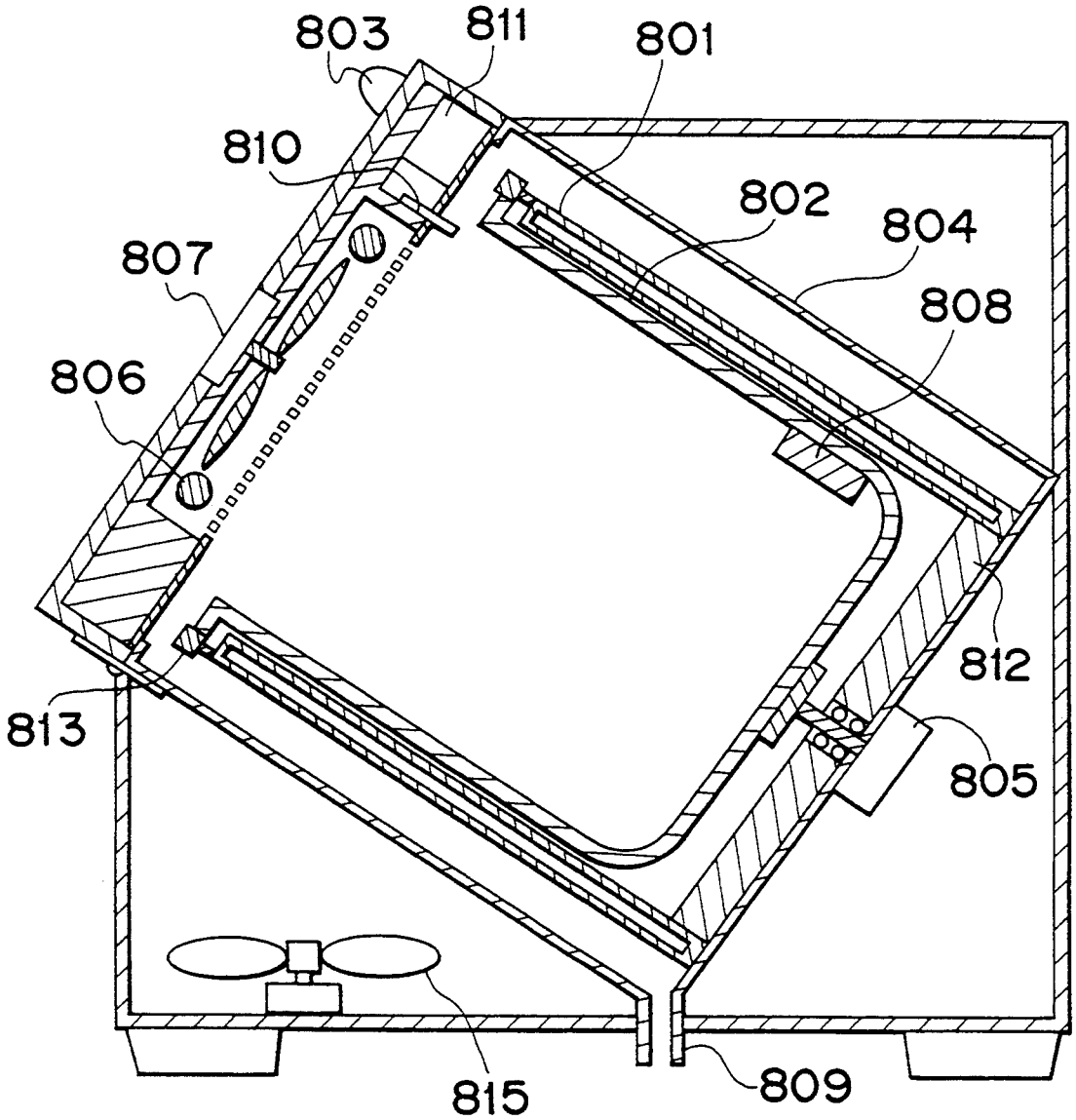
FIG. 10 is a sectional view showing an eighth embodiment of a dry-processing apparatus according to the present invention.

FIG. 10 shows an eighth embodiment of a dry-processing apparatus according to the present invention. Designated by reference numeral 801 is a vacuum heat-insulating container made of stainless steel in which a rotating container 802 is detachably installed in a slanted manner for accommodating objects such as food and garbage to be dried. Reference numeral 803 is a lid provided with a heat-insulating member on the inside thereof, which is opened and closed when the objects are inserted and removed from the rotating container 802. Reference numeral 804 is a condensing outer casing for condensing vapor generated from the drying object, which is cooled by a cooling fan 815. A drive motor 805 is provided under the bottom of the condensing outer casing 804 for directly rotating the rotating container 802. Reference numeral 806 is a heater which is attached to the lower side of the lid 803 and is located above the rotating container 802. Reference numeral 807 is an air feeding fan attached to the lower side of the lid 803 and is located above the rotating container 802. Reference numeral 808 is a stirring plate, numeral 809 is a draining tube for draining condensed water to the outside, and numeral 810 is a temperature sensor attached to the lid 803 to be located above the rotating container 802. Reference numeral 811 is a temperature control section for controlling the heater 806 in dependence on the temperature of the rotating container 802, and numeral 812 is a heat-insulating member provided in the bottom of the condensing outer casing 804, and numeral 813 is a support member for rotatably supporting the rotating container 802.

The following describes the operation of the apparatus.

First the lid is opened so as to place drying objects such as food or garbage into the rotating container 802. Next the heater 806 is turned on to heat the objects placed in the rotating container 802 and further the fan 807 is operated to feed a hot wind into the container 802 to heat the objects. At this time, the container 802 is rotated by the drive motor 805 to thereby stir the objects in the container 802.

The temperature of the container 802 is detected by the temperature sensor 810 during the dry-heating processing. The power application to the heater 806 is controlled by the temperature control section 811 in dependence on the detected temperature, to thereby adjust the heating condition of the objects in the container 802. The vapor generated by heating the objects using the heater 806 is partially heated again by the heater 806 and then fed to the objects again, and the remaining vapor is discharged from the container 802 so as to be contacted with the inner surface of the condensing outer casing 804 so that the contacted vapor is cooled and condensed to water which is exhausted to the outside of the apparatus via the drainage tube 809.

The air feeding fan 807 stirs the hot air generated by the heater 806 in the first step of the heating operation, and also stirs the vapor generated from the objects after the temperature of the objects reaches 100° C. in the heating process.

In this embodiment, an examination of the uniformity of the drying of the objects was performed using garbage. In the conventional heating system employing heat conduction and heat radiation using a heater, it was difficult to sufficiently heat the entire part of the objects uniformly because only the heated portion was dried and then formed an insulating layer. However, by combining a heater and a fan as taught in this embodiment, the entire details of the objects were sufficiently heated by the heated air. Further, by taking advantage of the overheated vapor having a large amount of energy for heating the objects again, the objects were uniformly and efficiently heated.

Moreover, by using the vacuum heat-insulating container having a good heat-insulating property, all of the garbage was uniformly dried, thereby allowing the objects to be efficiently heated. In addition, by rotating the container 802 in a slanted condition, the objects accommodated in the container 802 were sufficiently stirred, thereby suppressing scorching of the objects by contact with the container and adhesion of the objects to the inner surface of the container. At this time, the slanted angle of the container 802 may be selected within the range of 40 to 90° with respect to the vertical direction, and the larger the angle is, the more the stirring effect becomes.

In addition, by rotating the container 802 in forward and reverse directions, the objects were uniformly heated, and furthermore by increasing the crushing effect on the drying samples, the volume of the samples was reduced. Moreover, in this embodiment, since the surface of the samples was dried with heated air, the moist and sticky condition of the samples which occurred in the first step of the heating process was eliminated to thereby avoid the samples from sticking to the container 802 and being scorched, and thereby suppressing the contamination of the container 802. Moreover, by adjusting the power application to the heater to maintain a constant temperature of the container 802 in a range not higher than 130° C. the samples were uniformly heated to thereby suppress scorching.

With the construction as described above, the samples were sufficiently dried, thereby preventing the decomposition of the samples. In addition, by uniformly drying and heating in the vapor atmosphere, the generation of odor due to oxidation could be suppressed. Moreover, due to the circular stirring of the vapor by the fan 807, the heat-conductivity can be increased at the surface of the condensing outer casing 804, so that the vapor was efficiently condensed and at the same time the odor included in the vapor is mostly condensed to thereby improve the effect of deodorization and sharply reduce the dry-processing time. Assuming equal output of the heater, the processing time when using the fan is reduced to approximately one-fourth of that when using no fan.

Figure 11:
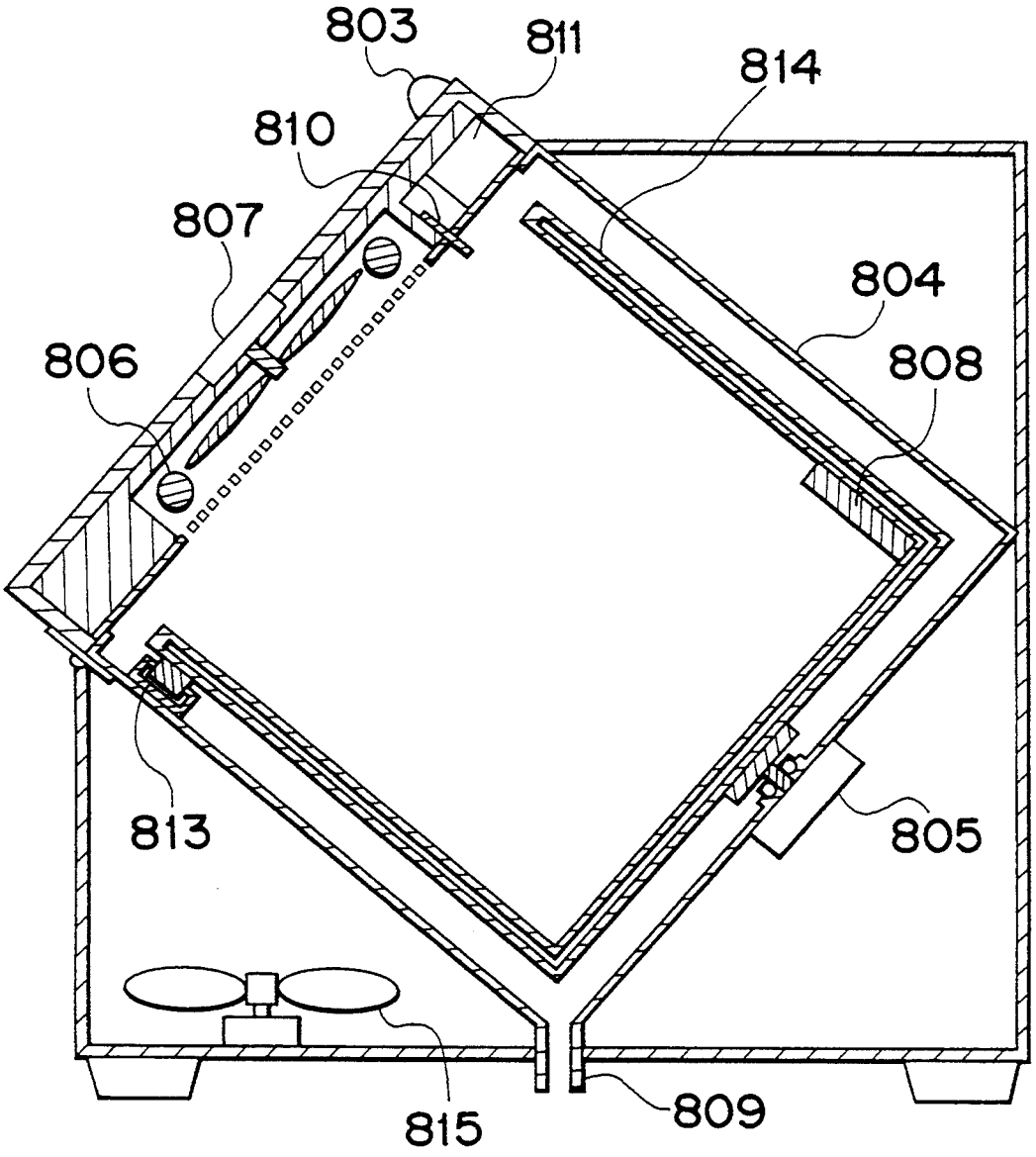
FIG. 11 is a sectional view showing a modified example of the eighth embodiment of FIG. 10.

FIG. 11 shows a modified example of the eighth embodiment of FIG. 10, wherein the difference between the modification shown in FIG. 11 and the eighth embodiment shown in FIG. 10 is that, in FIG. 11, the vacuum heat-insulating container 801 and the rotating container 802 are removed and a cup type container 814 is provided instead to serve as both the vacuum heat-insulating container and the sample accommodating container, thereby simplifying the apparatus.

Although the dry-processing apparatus of the present embodiment is used for disposing of garbage, the apparatus can be utilized for drying any kind of food or for cooking by controlling the drying temperature level. The condensing section may be provided with a deodorizer to deodorize the odor generated during or after the processing of the drying samples. Moreover, by coating the inner surface of the sample accommodating container with fluorine-based resin, adhesion of samples to the container can be prevented.

Furthermore, in this embodiment, although the ventilation fan 807 is provided in the door 803 located in the side of the heater 806, any fan may be located in any place so long as the heat and the excessively heated vapor can be fed to the samples. Moreover, the heater is not limited to a sheath heater. Rather, a halogen lamp, a ceramic heater or the like may be used as a heater. Moreover, although the drive motor is provided outside the bottom of the condensing container, the rotating means for rotating the container 802 is not limited to one which is directly driven by the drive motor.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dry-processing apparatus for disposing of garbage, comprising:

a shielding container made of a microwave shielding material;

a garbage receptacle having a heat-insulating property for containing garbage, said garbage receptacle being installed inside said shielding container with a space, through which vapor is allowed to pass, formed around said garbage receptacle;

a microwave oscillator means for generating microwave radiation and directing the microwave radiation to the garbage accommodated in said garbage receptacle to thereby heat the garage;

cooling means for cooling the wall of said shielding container so as to condense vapor emitted from the heated garbage; and temperature sensor means for detecting temperature in the atmosphere inside said garbage receptacle and detecting the temperature of the vapor emitted from the heated garbage, whereby a heating and drying operation is terminated at the moment the temperature detected by said temperature sensor means exceeds a predetermined temperature threshold in the final phase of the heating and drying operation.

2. The apparatus according to claim 1, wherein the temperature threshold to terminate the heating and drying operation is 120° C.

3. The apparatus according to claim 1 or claim 2, wherein a vapor exhaust hole is provided in an upper portion of said garbage receptacle, and said temperature sensor means is attached to the wall of said shielding container in such a manner that said temperature sensor means faces said vapor exhaust hole.

4. The apparatus according to claim 1 or claim 2, wherein a vapor exhaust hole is provided in an upper portion of said garbage receptacle, and said temperature sensor means is mounted through said shielding container wall at a position corresponding to said vapor exhaust hole in such a manner that said temperature sensor means is projected into the interior space of said garbage receptacle.

5. A dry-processing apparatus for disposing of garbage, comprising:

a garbage container for accommodating garbage, said garbage container being made of a heat-insulating material and also serving as a part of a microwave-shielding container for shielding microwaves;

a microwave generator for irradiating microwaves into said microwave-shielding container to heat the garbage accommodated in said garbage container;

a flow path for allowing vapor generated from the heated garbage to flow therethrough;

cooling means for cooling at least a portion of said flow path in order to cool the vapor flowing therethrough;

condensing means for condensing the cooled vapor into water; and wherein said garbage container comprises a doublewalled sidewall having an evacuated interior and which acts as a heat insulating sidewall, and a base formed of a microwave transmittable material and enclosing a bottom end of said doublewalled sidewall.

6. A dry-processing apparatus for disposing of garbage, comprising:

a microwave-shielding container for shielding microwaves;

a garbage container for accommodating garbage, said garbage container being made of a heat-insulating material mainly composed of metal and being mounted in said microwave-shielding container in such a manner as to form a vapor flow path between said garbage container and said microwave-shielding container;

a microwave generator for irradiating microwaves into said microwave-shielding container to heat the garbage accommodated in said garbage container and to cause vapor generated from the garbage to flow through said vapor flow path;

cooling means for cooling at least a portion of said microwave-shielding container in order to cool vapor in said flow path between said microwave-shielding container and said garbage container;

condensing means for condensing the vapor cooled by said cooling means, said condensing means being formed at least partially by walls of said microwave-shielding container;

a drain port in communication with said vapor flow path for discharging condensate from said microwave-shielding container; and temperature detecting means for detecting the temperature of the vapor so as to detect the degree of dryness of the garbage accommodated in said garbage container.

7. The apparatus as claimed in claim 5, wherein said double-walled sidewall is made of a metal material.

8. The apparatus as claimed in claim 6, wherein said garbage container comprises a vacuum heat-insulating container having a double-wall structure with an evacuated interior and made of a metal material, and a base seat made of a microwave transmittable material at a bottom portion of said vacuum heating-insulating container.

9. The apparatus as claimed in claim 7, further comprising a drain tube provided downstream of said drain port; exhaust means operably coupled to said drain tube for exhausting gases to outside of said apparatus; and a deodorizer for deodorizing the gases before being exhausted to outside of said apparatus.

10. A dry-processing apparatus for heating and drying objects to be processed, comprising:

a rotatable receptacle for accommodating objects to be dried, said rotatable receptacle being supported for rotation around a tilted axis;

drive means for rotating said rotatable receptacle;

heating means for heating the objects accommodated in said rotatable receptacle;

a condensing container surrounding said rotatable receptacle, said condensing container having an opening and a lid member to close said opening;

cooling means for cooling said condensing container; and a communicating path defined between said rotatable receptacle and said condensing container, wherein the wall material of said rotatable receptacle has a lower thermal conductivity, in a transverse direction across the wall, than the wall material of said condensing container.

11. The apparatus according to claim 10, wherein said heating means is a microwave generator.

12. The apparatus according to claim 10, wherein said rotatable receptacle further includes a protruding member on an interior side wall thereof; and a plastic bag is provided in said rotatable receptacle in contact with said protruding member for accommodating objects to be dried.

13. The apparatus according to claim 12, wherein said heating means is an electric heater.

14. The apparatus according to claim 10, further comprising deodorizing means located in the vicinity of a lower end of said condensing container.

15. A dry-processing apparatus for heating and drying objects to be processed, comprising:

receptacle means for accommodating objects to be dried by heating, said receptacle means having at least a part of its bottom made of a microwave transmittable material;

condensing means for vapor generated from the heated objects, said condensing means surrounding said receptacle means and having an opening, a lid member to close said opening and a microwave inlet portion at a bottom portion of said condensing means;

microwave generator means for radiating microwaves through said microwave inlet portion to heat the objects accommodated in said receptacle means;

cooling means for cooling the outer surface of said condensing means; and rotation drive for rotating said receptacle means in a slanted condition.

16. The apparatus as claimed in claim 15, wherein said receptacle means is constructed by separately providing an inner container made of a microwave transmittable material and an outer cylindrical container made of a heatinsulating material and placed outside said inner container, said outer cylindrical container being fixed to said condensing means such that only said inner container is rotated by said rotation drive means.

17. The apparatus as claimed in claim 15, wherein said rotation drive means comprises: a spindle serving as a rotating shaft of said inner container; a motor for rotating the spindle; coupling means for detachably coupling said inner container to said motor; and a rotation assisting member provided at an upper end portion of said inner container in contact with an inner surface of said outer cylindrical container.

18. The apparatus as claimed in claim 15 or 16, wherein said inner container comprises a ring member for reducing the inner diameter of said inner container, and said ring member is located at an upper peripheral portion of said inner container.

19. The apparatus as claimed in claim 17, wherein said inner container comprises a cylindrical side wall made of a heat-insulating material, and a bottom which is made of a microwave transmittable material and is integrally connected to said cylindrical side wall.

20. The apparatus as claimed in claim 15 or 16, wherein said microwave inlet is formed diagonally above the center of said spindle at the bottom of said condensing means.

21. The apparatus as claimed in claim 15 or 16, further comprising temperature detecting means provided internally at said lid member of said condensing means and above said receptacle means for detecting the temperature of the vapor generated from the objects.

22. A dry-processing apparatus for disposing of garbage, comprising:

garbage receptacle means for accommodating garbage;

means for heating the garbage accommodated in said garbage receptacle means;

condensing means, located outside of and surrounding said garbage receptacle means, for condensing vapor generated from the garbage when heated by said heating means, a vapor flow passage being defined by a space formed between said condensing means and said garbage receptacle means for allowing vapor generated from the garbage to flow outside of the apparatus;

cooling means for cooling said condensing means; and heat-insulating means for thermally insulating said garbage receptacle means from said condensing means.

23. The apparatus as claimed in claim 22, wherein said heat-insulating means has a double-wall structure with an evacuated interior and which is made of a metal material.

24. A dry-processing apparatus for heating and drying objects to be processed, comprising:

receptacle means for accommodating objects to be dried, said receptacle means being slanted with respect to the vertical direction;

heating means for heating the objects and vapor generated from the objects, said heating means being located above said receptacle means;

air feeding means, located above said receptacle means, for feeding hot air heated by said heating means into said receptacle means;

means for rotating said receptacle means; and condensing means, surrounding a side wall of said receptacle means, for condensing the vapor generated from the objects into water.

25. The apparatus according to claim 24, further comprising heat-insulating means interposed between said receptacle means and said condensing means.

26. A dry-processing apparatus for heating and drying objects to be processed, comprising:

receptacle means composed of a vacuum heatinsulating container for accommodating objects to be dried, said vacuum heat-insulating container being slanted with respect to the vertical direction;

heating means, located above said receptacle means, for heating the objects and vapor generated from the objects;

air feeding means, located above said receptacle means, for feeding hot air heated by said heating means into said receptacle means;

rotating means for rotating said receptacle means around an axis tiled with respect to the vertical direction; and condensing means, surrounding said receptacle means, for condensing the vapor generated from the objects into water.

* * * * *